US006217725B1

(12) United States Patent
Van Anglen et al.

(10) Patent No.: US 6,217,725 B1
(45) Date of Patent: Apr. 17, 2001

(54) METHOD AND APPARATUS FOR ANODIZING

(75) Inventors: Erik S. Van Anglen, deceased, late of Gheens, LA (US), by Marilyn Van Anglen, legal representative; Harold M. Keeney; James L. Forand, both of Whitehall, PA (US)

(73) Assignee: Electroplating Technologies Ltd., Northampton, PA (US)

( * ) Notice: Subject to any disclaimer, the term of this patent is extended or adjusted under 35 U.S.C. 154(b) by 0 days.

(21) Appl. No.: 08/954,530

(22) Filed: Oct. 20, 1997

Related U.S. Application Data

(63) Continuation-in-part of application No. 08/533,500, filed on Sep. 25, 1995, now Pat. No. 5,679,233, which is a continuation-in-part of application No. 08/179,520, filed on Jan. 10, 1994, now Pat. No. 5,462,649, which is a continuation-in-part of application No. 08/316,530, filed on Sep. 30, 1994, now Pat. No. 5,476,578.

(51) Int. Cl.[7] ..... C25D 7/06

(52) U.S. Cl. ..... 204/207; 204/217; 204/272; 204/289

(58) Field of Search ..... 204/207, 217, 204/242, 272, 279, 232, 227; 205/93, 129, 130, 138, 151, 152

(56) References Cited

U.S. PATENT DOCUMENTS 5,679,223 * 10/1997 Van Anglen et al. ..... 204/207

* cited by examiner

*Primary Examiner*—Bruce F. Bell
(74) *Attorney, Agent, or Firm*—Charles A. Wilkinson

(57) ABSTRACT

A resilient dielectric wiper blade is mounted between electrodes and a workpiece, particularly in an anodizing operation, to wipe bubbles of oxygen from the anodic work surface, to remove a surface layer of excessively heated electrolytic solution and replace with fresh cooler solution, and in the case of flexible strip processing, to stabilize the strip between cathodes. The resilient dielectric wiper blade is preferably used with perforated electrodes to facilitate removal of overheated electrolytic solution and replace with freshly circulated solution.

37 Claims, 18 Drawing Sheets

Fig. 1
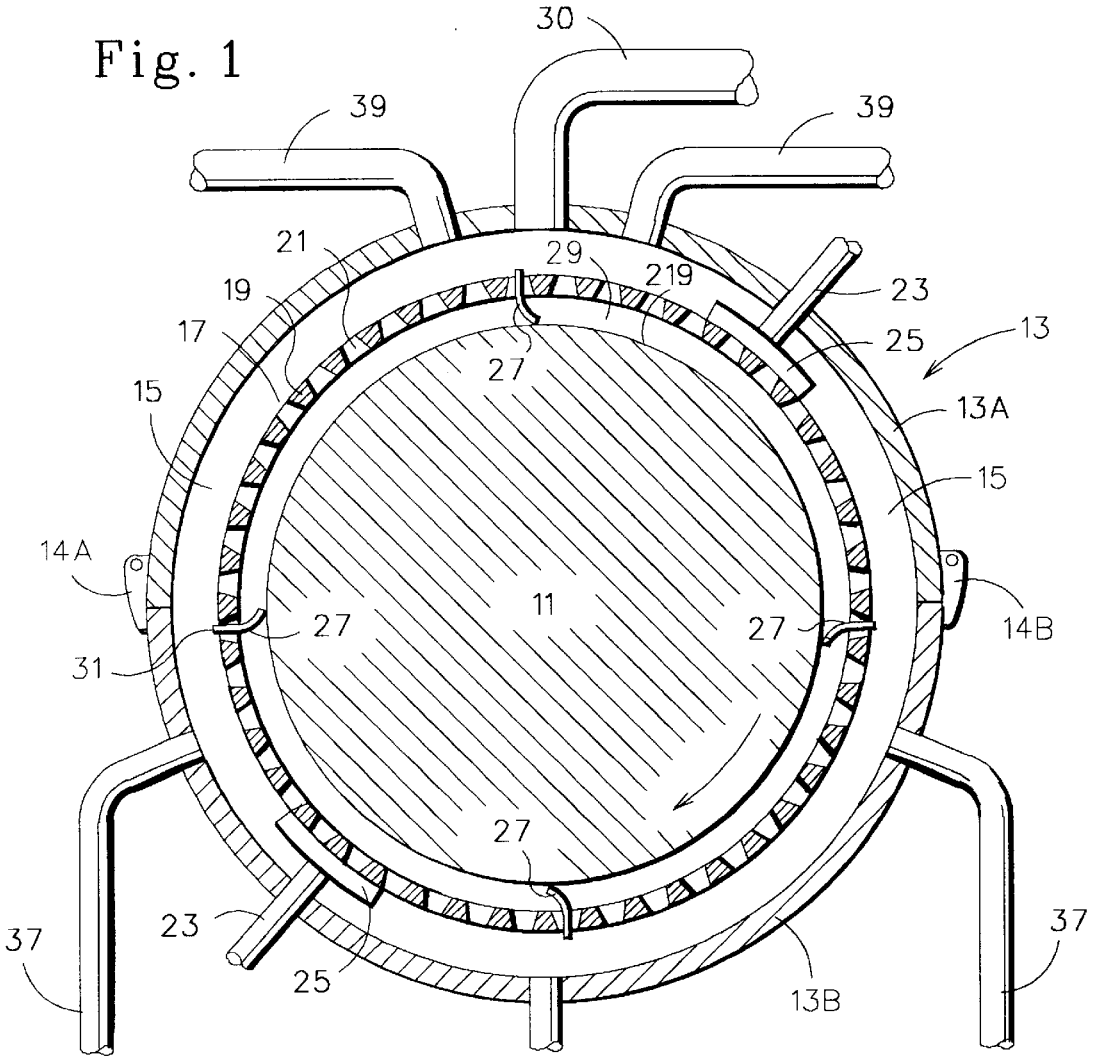
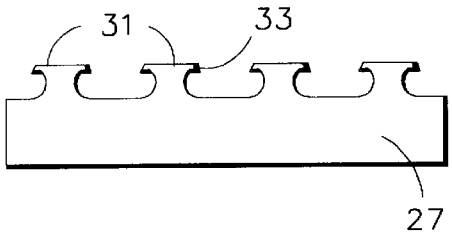
Fig. 2

121a
121b
122a
122b
123
125a
125b
127
129
131
133
135
137
171
173
174
175
6
X

Fig. 24
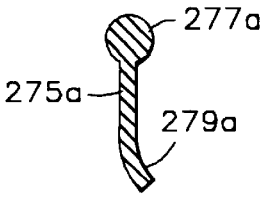
Fig. 25
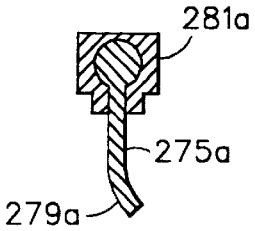
Fig. 26
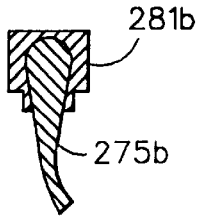
Fig. 32
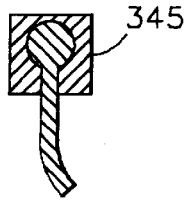
Fig. 33
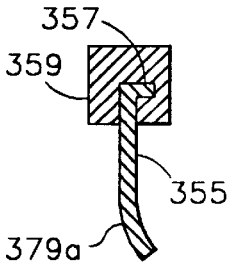
Fig. 34
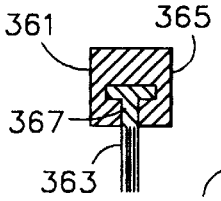
Fig. 35
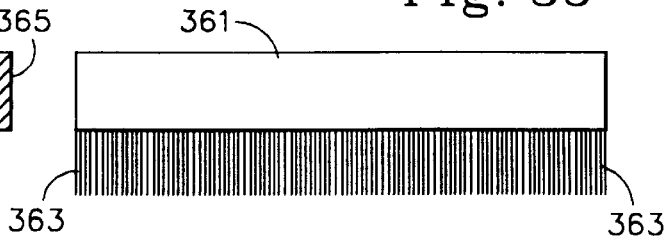
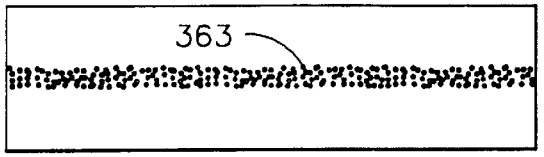
Fig. 36
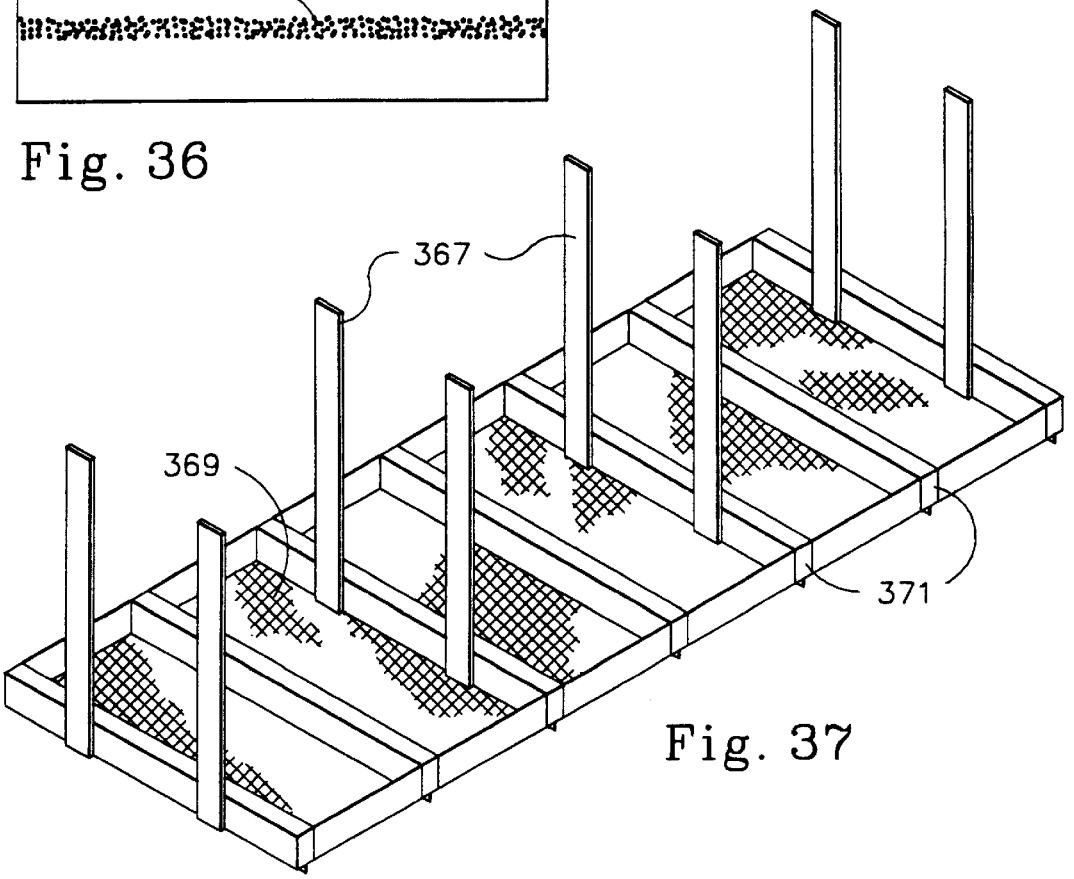
Fig. 37

Fig. 41
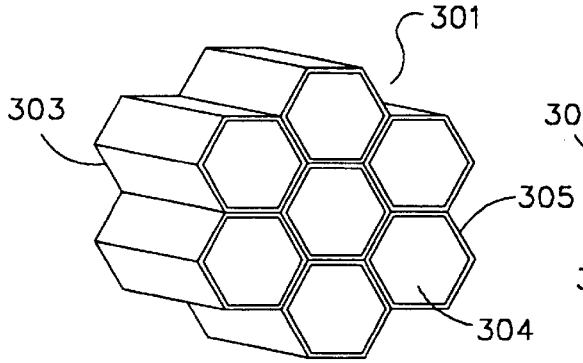
Fig. 42
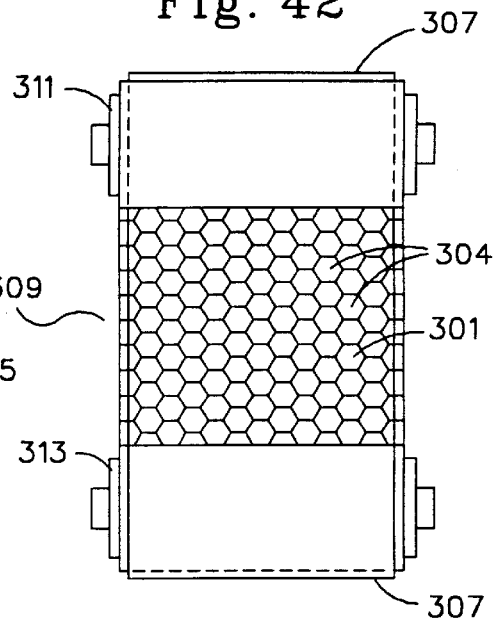
Fig. 43
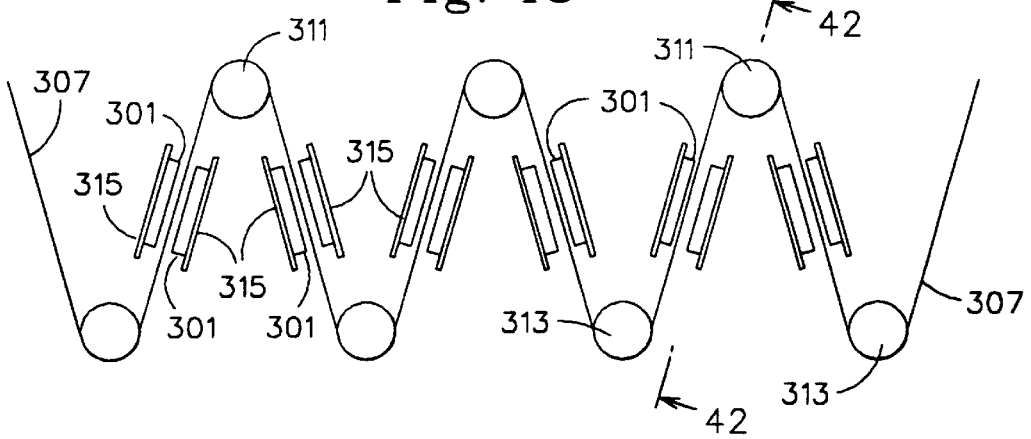
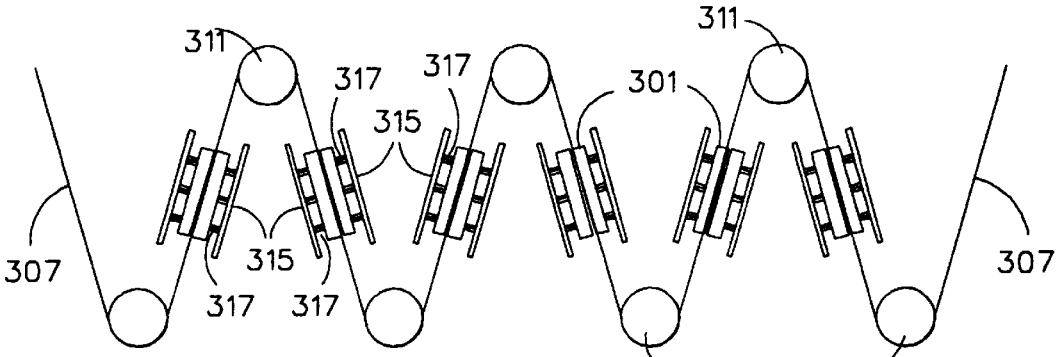
Fig. 44

FIg. 45
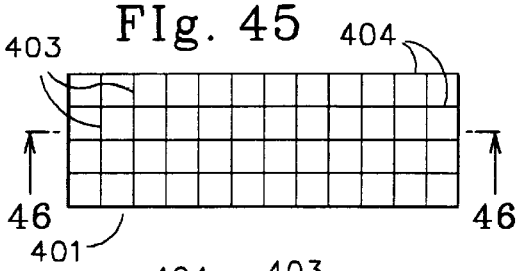
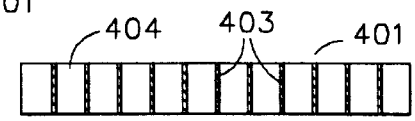
Fig. 46
Fig. 49
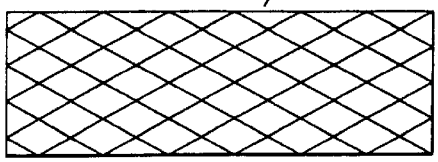
Fig. 50
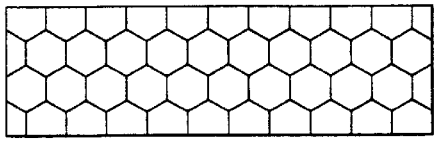
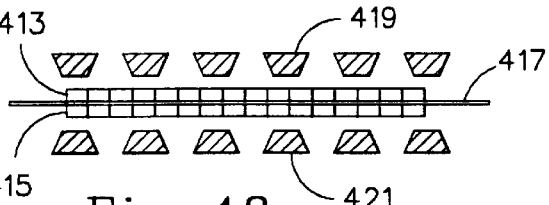
Fig. 48
Fig. 51
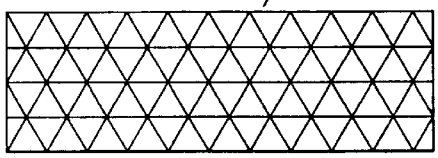
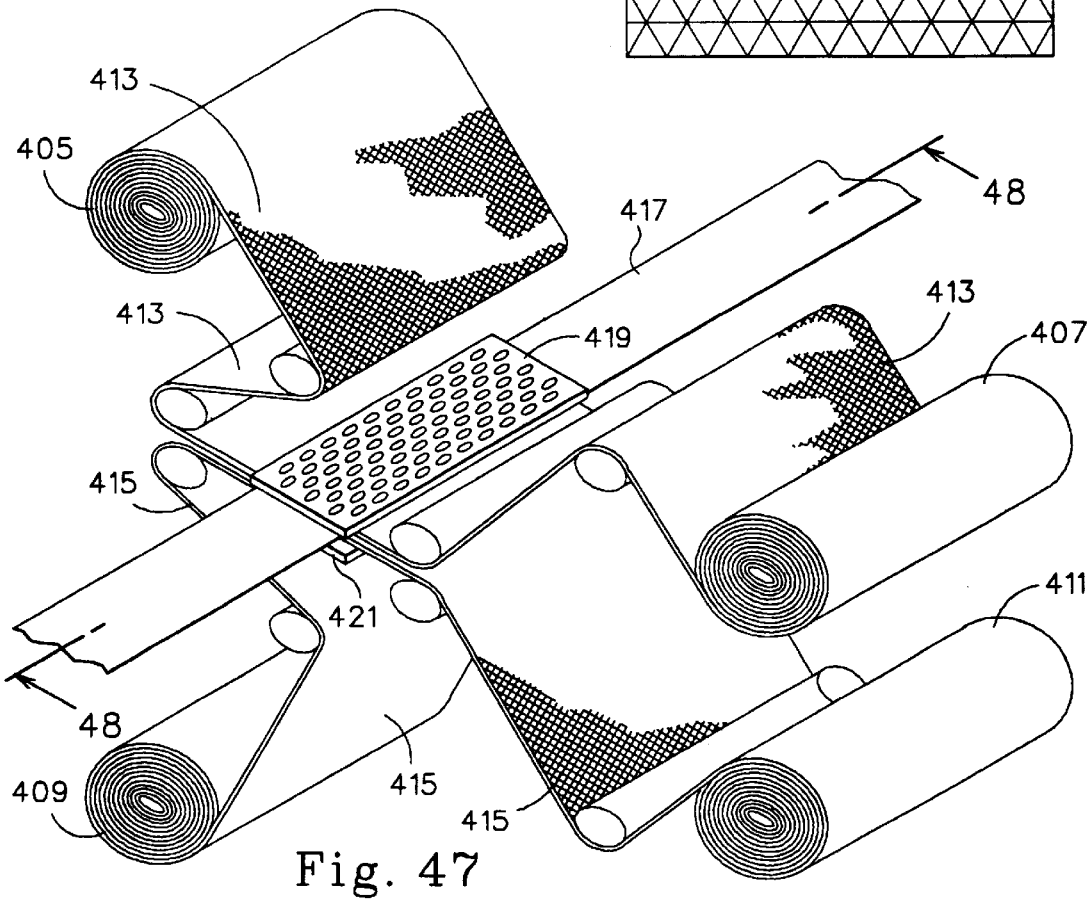
Fig. 47

METHOD AND APPARATUS FOR ANODIZING

RELATED APPLICATIONS

This application is a continuation-in-part of U.S. application Ser. No. 08/533,500 filed Sep. 25, 1995, now U.S. Pat. No. 5,679,233 which is a continuation-in-part of U.S. application Ser. No. 08/179,520 filed Jan. 10, 1994, now U.S. Pat. No. 5,462,649 and U.S. application Ser. No. 08/316,530 filed Sep. 30, 1994, now U.S. Pat. No. 5,476,578, by the present inventors and from which priority and continuity is claimed.

BACKGROUND OF THE INVENTION (1) Field of the Invention

This invention relates to electrochemical processing of the surfaces of metal substrates and the like to provide corrosion-resistant and decorative coatings from chemical treatment baths. More particularly, this invention relates to the so-called anodizing of metallic surfaces and more particularly to the use of a substantially solid flexible wiper blade during such anodizing.

(2) Prior Art

As detailed more particularly in U.S. application Ser. Nos. 08/179,520 filed Jan. 10, 1994 and 08/316,530, filed Sep. 30, 1994, the disclosures of which are hereby expressly incorporated into and made a part of this application, it has been found by the present inventors as well as others that a serious problem in electrolytic plating is the formation of bubbles of hydrogen on the surface of the material being coated and that it is conducive to good coating results to remove such hydrogen bubbles from a cathodic work surface. If nothing is done to remove the hydrogen from the coating surface during the coating process, coating will usually continue, but it may be seriously interfered with by the increasing size and number of bubbles. Likewise, in the anodizing of metallic surfaces in which the workpiece is made anodic and electrochemical oxygenation of the work surface creates a corrosion-resistant and/or decorative oxidized surface, the anodic workpiece tends to collect oxygen bubbles and the adjacent cathodes collect hydrogen bubbles that interfere with the electrochemical processing. Difficulty is also often encountered in anodizing with excessive heating of the solution layer next to the anode due to the high currents used in the process and the resistance of the dielectric metal oxide layer on the surface of the workpiece as such oxide layer thickens.

A second significant problem which has been long recognized in electrolytic coating baths is depletion of the electrolytic solution as coating progresses. The coating bath next to a workpiece may in particular become locally depleted of coating metal ions.

A further problem in the continuous coating of a flexible material such as sheet, strip and wire products is that the efficiency of electroplating usually increases as the spacing between the electrodes, one of which is the material to be coated, decreases. The same is true in anodizing. In other words, the efficiency of coating is usually inversely related to the spacing between the electrodes, one of which is the workpiece. However, due to the flexibility of the material being coated, it must, as a practical matter, be held away from the opposing electrode a sufficient distance to prevent arcing between the work material and the coating electrodes or anodes in the case of electroplating, or cathodes in the case of anodizing.

There has been a need, therefore, in the case of electroplating, for a means for removing hydrogen bubbles and cathodic film from a cathodic coating surface, preventing localized depletion of the coating bath with respect to coating material as well as allowing closer spacing of the coating electrodes and material being coated. The present applicants have found that a very effective means for accomplishing all three of these purposes is by the use of a relatively thin wiping blade in various embodiments applied to the surface of the workpiece at spaced intervals with a light contact. Such wiping blade deviates or strips away from the coating surface the relatively stable surface layer of electrolyte which tends to be drawn along with a moving cathodic surface, mixing and encouraging replenishing of the electrolyte next to the cathodic surface. Such blade at the same time wipes or sweeps away bubbles of hydrogen as well as encourages coalescence of small bubbles and films of hydrogen into large bubbles for subsequent wiping away. In addition, the wiping blade very effectively supports the material being coated, particularly in the case of relatively flexible material, such as light gauge thickness flat rolled sheet metal and prevents its deviation from its intended path and, therefore, allows closer spacing of the coating electrodes and the surface of the material being coated. The application of thin flexible wiping blades to the electroplating of metal substrates has been disclosed and claimed in applicants' prior applications noted above upon which this application is a continuation-in-part of a continuation-in-part and from which priority and continuity is claimed.

The present inventors have now found that some of the same benefits attained in electrocoating are likewise obtained in the process of anodizing if the discontinuous blades of the invention are used to prevent the accumulation of bubbles of oxygen on the anodic workpiece and also to decrease the heating of the solution next to the anodic workpiece while permitting closer spacing between the anodic workpiece and the cathodic electrodes. The flexible wiping blades of the invention also significantly reduce the power requirements of the process, other things being equal, by allowing closer approach of the workpiece and the adjacent electrodes. Some of the more pertinent prior art patents generally illustrating the history of the development of various solutions to some of the above-noted problems, particularly with respect to electrocoating, are U.S. Pat. Nos. 442,428 issued Dec. 9, 1890 to F. E. Elmore, 817,419 issued Apr. 10, 1906 to O. Dieffenbach, 850,912 issued Apr. 23, 1907 to T. A. Edison, 1,051,556 issued Jan. 28, 1913 to S. Consigliere, 1,236,438 issued Aug. 14, 1917 to N. Huggins, 1,473,060 issued Nov. 6, 1923 to E. N. Taylor, 1,494,152, issued May 13, 1924 to S. O. Cowper-Coles, 2,473,290 issued Jun. 14, 1949 to G. E. Millard, 3,183,176 issued May 11, 1965 to B. A. Schwartz, Jr, 3,715,299 issued Feb. 6, 1973 to R. Anderson et al., 3,751,346 issued Aug. 7, 1973 to M. P. Ellis et al., 3,772,164 issued Nov. 13, 1973 to M. P. Ellis et al., 3,886,053 issued May 27, 1975 to J. M. Leland, 4,125,447 issued Nov. 14, 1978 to K. R. Bachert, 4,176,015 issued Nov. 27, 1979 to S. Angelini, 4,210,497 issued Jul. 1, 1980 to K. R. Loqvist et al., 4,235,691 issued Nov. 25, 1980 to K. R. Loqvist, 4,399,019 issued Aug. 16, 1983 to W. A. Kruper et al., 4,595,464 issued Jun. 17, 1986 to J. E. Bacon et al., 4,853,099 issued Aug. 1, 1939 to G. W. Smith and 4,931,150 issued Jun. 5, 1990 to G. W. Smith. Some prior patents related to anodizing as well as some of the above problems are U.S. Pat. Nos. 3,074,857 issued Jan. 22, 1963 to D. Altenpohl, 3,650,910 issued Mar. 21, 1972 to G. W. Froman, 3,865,700 issued Feb. 11, 1975 to H. A. Fromson, 4,152,221 issued May 1, 1979 to F. G. Schaedel, U.S. Pat.

No. 4,502,933 issued Mar. 5, 1985 to T. Mori et al. and 4,248,674 issued Feb. 3, 1981 to H. W. Leyh.

The following patents from the above compilation of patents are particularly illustrative of some of the more interesting disclosures of problems and solutions found in the above listed prior art.

U.S. Pat. No. 1,473,060, issued Nov. 6, 1923 to E. N. Taylor, discloses the use of a brush-type wiper in a coating tank environment to remove small gas bubbles and solid impurities from the coating surface intermittently (about 3 seconds out of every minute of coating) allowing the coating process to proceed uninterrupted during the time the brush is not operating.

U.S. Pat. No. 1,494,152, issued May 13, 1924 to S. O. Cowper-Coles, contains an early disclosure of a depleted layer of electrolyte carried around adjacent to the surface of a cathodic workpiece as well as bubbles of gas on the surface. The Cowper-Coles solution to these problems is to rapidly oscillate the cathodic workpiece to in effect shake off the bubbles and depletion layer (referred to by Cowper-Coles as the cathodic layer). The brushing takes place above the electrolyte surface as the hoop-type workpiece rotates into and out of the electrolyte.

U.S. Pat. No. 2,473,290 issued Jun. 14, 1949 to G. E. Millard discloses an electroplating apparatus for plating crankshafts and the like with chromium in which a curved anode partially surrounds the portion of the workpiece to be coated. The curved anode has orifices in its surfaces to allow the escape of bubbles formed during the coating process and also has extending through its surface, a support for a so-called positioning block or scraper block 54 which is provided to maintain a close spacing between the anode and cathodic workpiece. Millard states also that his spacing block removes gas bubbles from the cathode and also removes threads of chromium. He also states that the block, which has a significant width along the line of coating, dresses and polishes the cathode during plating. The aim of Millard, is clearly to burnish or compact the coating surface somewhat in the manner of the earlier Huggins patent. While Millard talks, therefore, about scraping off the gas bubbles and also removing "threads" of chromium by which it is understood that he means dendritic material, he is primarily interested in conducting a burnishing operation and spacing his cathode from his anode by his relatively wide spacer block.

U.S. Pat. No. 2,844,529 issued Jul. 22, 1958 to A. Cybriwsky et al. discloses a process and apparatus for rapidly anodizing aluminum. The Cybriwsky patent proposes maintaining a constant temperature differential between the aluminum surface and the electrolytic bath. Contact rolls are spaced throughout the apparatus but are not used for the purposes of removing gas bubbles from the metal strip.

U.S. Pat. No. 3,079,308 issued Feb. 26, 1963 to E. R. Ramirez et al. discloses a typical process of anodizing including a pumping means to transfer electrolyte onto the surface of the metal strip. A contact cell is used to provide a positive charge on the anode. There is no disclosure of a method for removing gas bubbles from the strip.

U.S. Pat. No. 3,183,176 issued May 11, 1965 to B. A. Schwartz, Jr., discloses the electrolytic treatment or coating of a bore by use of a brush coating apparatus mounted on a drill press. The inside of the bore is acted upon by a series of centrifugally extended rotating vanes having dielectric outer covers.

U.S. Pat. No. 3,359,189 issued Dec. 19, 1967 to W. E. Cooke et al. discloses a continuous anodizing process and apparatus wherein the turbulent longitudinal flow of electrolyte (as opposed to the more traditional streamline flow), either concurrent or countercurrent along the continuous workpiece, allows for increased thickness of anode oxide coating films. The Cooke et al. patent does not fully explain why increasing the turbulence of the electrolyte flow bolsters the coating efficiency. It is believed by Cooke et al., however, that the turbulent electrolyte helps disperse heat from the coating surface.

U.S. Pat. No. 3,650,910 issued Mar. 21, 1972 to G. W. Froman discloses a method for anodizing an aluminized steel strip wherein gas bubbles (both $H_2$ and $O_2$) are prevented from accumulating on the strip by moving the strip at faster speeds. The speed, as disclosed in the specification, is approximately 30 feet/minute. The Froman technique is an entirely different approach from both the use of a flexible wiper means and the electrolyte agitation technique described above to remedy the problem of bubble accumulation.

U.S. Pat. No. 3,715,299, issued Feb. 6, 1973 to R. Anderson et al. includes a disclosure of plastic vanes positioned close to a workpiece to cause turbulence and break up a boundary layer upon an adjacent cathodic workpiece. Anderson et al. does not directly sweep away the boundary layer or gas bubbles, but only causes turbulence and believes this at least partially breaks up and discourages the formation of a boundary layer.

U.S. Pat. No. 4,125,447 issued Nov. 14, 1978 to K. R. Bachert, discloses the use of a brush attached to a movable anode within a hollow member being electroplated. The brush comprises a plurality of bristles made from plastic or other insulated material which rub against the inside surface of the tube being electroplated as the anode vibrates.

U.S. Pat. No. 4,176,015 issued Nov. 27, 1979 to S. Angelini, discloses the brushing of the surface of a series of bars as they are passed in a straight line through an anode immersed within an electroplating bath. The brushing is provided by a glass fiber brush comprising a blade having a layer of fiber scraping material compressed between side plates which is said to remove a cathodic film from the coated surface.

U.S. Pat. No. 4,210,497 issued Jul. 1, 1980 to K. R. Loqvist et al. discloses the coating of hollow members including movement inside the cavity of such members of an electrolytic solution by means of a "conveyor" which consists of a resiliently and electrically insulating material such as perforated, net-like or fibrous strip which is wound helically around a reciprocating anode. The function of the resilient electrically insulated material is to act as a conveyor of electrolyte, foam and gases which can be supplemented by forming the anode as a screw conveyor.

U.S. Pat. No. 4,227,291 issued Oct. 14, 1980 to J. C. Shumacher discloses an energy efficient process for the continuous production of thin semiconductor films on metallic substrates. The process is a cathodic deposition of germanium or silicon from an electrolyte upon an aluminum-coated steel substrate. The patent thus discloses a cathodic coating process rather than an anodizing process. The patent discloses, however, a suction apparatus that removes spent electrolyte and recirculates it. There is no device used for the specific purpose of removing gas from the vicinity of the strip, including no flexible wiping blades.

U.S. Pat. No. 4,235,691 issued Nov. 25, 1980 to K. R. Loqvist, discloses the use of angular plastic wiping blades upon the surface of a round workpiece during electroplating. The angular plastic blades are mounted in a cylindrical mounting that rotates about the round workpiece. Bubbles of hydrogen are wiped from the surface by the blades.

U.S. Pat. No. 4,248,674 issued Feb. 3, 1981 to H. W. Lehy discloses an anodizing process for producing anodized aluminum stock for lithography in which a differential anodized coating is placed on the two sides. The operation of a contact cell is explained and the use of a perforated cathode disclosed to facilitate circulation of electrolyte. No use of thin wiper blades or the removal of gases from the strip or foil surface is disclosed.

U.S. Pat. No. 4,399,019 issued Aug. 16, 1983 to W. A. Kruper et al. discloses a modified tank type coating process and apparatus in which a boundary layer is broken up on an interior coating surface by use of a series of mixing blades or vanes. Kruper et al. uses "mixing blades or vanes," and preferably moving blades to essentially stir up his electrolytic solution between a perforated anode and the interior surface of his workpieces and, therefore, disturb or mix the boundary layer which develops on the work surface, which boundary layer becomes quickly depleted of coating material and replace it with a mixture of depleted and fresh electrolytic solution. Kruper et al. uses hard plastic vanes attached to his perforated anode. The plastic vanes are more or less triangular in shape or cross section with one side of the top attached to the perforated anode, the other side of the top forming the leading edge of the blade, and the base forming the trailing edge of the blade. As the blades move in a circle within the space between the internal surfaces of the bearing housings which are to be coated and the surface of the moving or rotating anode, the flat leading surface of the blades stirs the electrolytic solution and causes turbulence which mixes the solution in the working space and causes flow both inwardly and outwardly through the orifices in the rotating anode assembly into and from the main body of coating solution within the center of the perforated anode assembly. Kruper et al. indicates that he prefers to maintain a space between his stirring blades and the coating surface of the workpiece. However, in an incidental disclosure without details, Kruper et al. also indicates that the stirring blade could less desirably extend to the coated surface and in such case it is preferred that the blades be somewhat resilient such as in a windshield wiper or a brush. Exactly what sort of shape this would be is not clear, but it seems clear in either case that the resiliency would cause the triangular structure shown to be compressed inwardly, forming a seal between the blade and the coated surface interfering with the electrocoating operation.

U.S. Pat. No. 4,502,933 issued Mar. 5, 1985 to T. Mori et al. discloses an apparatus for electrolytic treatment including anodizing of a metal web. The Mori et al. patent addresses the problem of gas accumulation and provides some historical background noting past solutions in this area. According to the Mori et al. patent, electrolyte agitation appears to be the traditional solution towards reducing bubble formation. Because electrolyte agitation requires a much larger pump, however, the added power consumption negates the cost-saving benefits from the removal of the gas. Another solution noted by Mori et al. has been transporting the aluminum web vertically through the bath. Problems stemming from this technique include supplying sufficient power to the metal web and the added maintenance cost of the unusual design. Finally, a partition plate method is stated by Mori et al. to be disclosed in Japanese Patent Publication No. 21840/80 wherein partition plates extend "along the length" of the aluminum web in the bath and apparently perpendicular to the aluminum web in the bath. The partition plates form a channel which intensifies the agitation of the electrolyte. By narrowing the region with the plates, the agitation removes the bubbles from the metal surface more effectively. This technique, like the first technique described, requires a larger pump and therefore suffers from the same disadvantages. The Mori et al. patent, like the other techniques, attempts to remove bubbles by agitating the flow of electrolyte. Electrical insulating members extend transverse of the direction of a metal web and above the level of the electrodes adjacent the web surface and therefore spaced from the web surface to allegedly vigorously agitate the electrolyte in the vicinity of the web.

U.S. Pat. No. 4,595,464 issued Jun. 17, 1986 to J. E. Bacon et al., discloses the use of a so-called brush belt for continuously treating a workpiece. The brush belt is in the form of a continuous loop which passes over suitable rollers or pulleys and brings plating solution in the brush portion to the plating area. Essentially, Bacon et al. provides an absorbent belt which passes in opposition to the material to be coated.

U.S. Pat. No. 4,853,099 issued Aug. 1, 1989 to G. W. Smith discloses a so-called gap coating apparatus and process in which a relatively small elongated gap is established through which coating solution is passed at a high rate. It is said that the ultra high flow rate allows very high current densities. It is stated the process is not well suited for chromium plating, because high current densities do not increase the plating out of chromium.

U.S. Pat. No. 4,931,150 issued Jun. 5, 1990 to G. W. Smith, discloses a so-called gap-type electroplating operation in which a selected area of workpieces is coated by forming an electrode closely about such so-called gap and passing electrolytic solution through the gap at a high rate. It is stated that the ultra-high volume flow assures the removal of gas bubbles, the maintenance of low temperature and high solution pressure contact with the anode surface and a workpiece surface. It is stated that gaps approaching 2.5 inches can employ the invention, but the gap would preferably be smaller, but at least 0.05 inches in width. It is stated that a fresh plating solution having a controlled temperature and no staleness is available at all times in the gap for uniform plating and while in high pressure contact with the surface of the gap. In practice, the plating solution is forced in a vertically upward direction so that any gas generated by the electrolysis in the gap migrates upwardly in the same flow direction as the plating solution is being driven and, therefore, can readily escape. It is also stated that chromium is difficult to use in the invention because chromium deposits slowly regardless of current density so that the deposition is slow and the advantages of gap plating are not fully attained.

While other processes and apparatus have, therefore, been available to remove hydrogen bubbles from cathodic coating surfaces, sever and remove dendritic material in coating processes such as the electrolytic coating of chromium and prevent depletion of the electrolytic solution and to some extent, establish a desirable coating gap between the coating electrode and the material being coated, all such prior processes have had drawbacks and none has been effective to accomplish all four or even two or three of the disclosed aims of the present invention by themselves. The same is true, generally, with respect to anodizing of workpieces including the anodizing of aluminum strip, aluminized steel, aluminum foil for capacitor production, aluminum for lithography, and other suitable metals such as magnesium and copper, various aluminum alloys and even stainless steel where a colored oxide on the surface is desired.

OBJECTS OF THE INVENTION

It is an object of the present invention, therefore, to provide an apparatus which wipes the surface of an anodic workpiece to remove oxygen bubbles during anodizing.

It is a further object of the invention to wipe the surface of an anodic workpiece with a solid contact blade wiper to remove oxygen bubbles from such surface.

It is a still further object of the invention to provide a solid wiper with an extended contact surface resiliently biased against the surface of an anodic workpiece to detach bubbles of molecular oxygen which have coalesced from ionic oxygen liberated in the electrolyte so that such bubbles can be removed before they interfere with the anodizing process.

It is a still further object of the invention to provide a substantially solid wiper blade biased against an anodic work surface in a manner such that the solid wiper blade blocks forward movement of the electrolyte along the surface of the workpiece forcing used solution away from the surface and causing fresh solution to flow in behind the wiping blade, thus effectively forcing exchange of coating solution to prevent overheating of such solution adjacent the anodic surface.

It is a still further object of the invention to provide a substantially solid wiping blade having a restricted cross section and resilient so that the blade when biased against an anodic coating surface in a flexed configuration bears against the surface and both dislodges oxygen bubbles from such surface, blocks the passage of electrolytic solution past such resilient blade and steadies the material being coated.

It is a still further object of the invention to provide a substantially solid wiper having an extended contact blade biased against an anodic work surface by resilient means which either biases the wiper blade in its own plane toward the anode surface or pivotably toward the anode surface.

It is a still further object of the invention to provide a substantially solid thin dielectric wiper between guide rolls in the continuous anodizing of flexible substrate material.

It is a still further object of the invention to combine a substantially solid wiper blade with a perforated cathode adjacent to an anodic work surface to maximize the efficiency of interchange of electrolyte by the wiper blades.

It is a still further object of the invention to provide a thin dielectric material acting as a supporting guide for flexible base material during anodizing in an electrolytic anodizing bath.

Additional objects and advantages of the invention will become evident from review of the following description and explanation in conjunction with the appended drawings.

BRIEF DESCRIPTION OF THE INVENTION

It has been discovered that a very effective acceleration of anodizing plus the production of considerably better quality anodized product can be attained by the use of a wiper blade or thin dielectric guide bearing upon material to be coated, said wiper or guide blade having a substantially solid wiping or support edge portion which is resiliently biased against the anodic work surface. The blade itself may be resilient or it may be biased against the coating surface by associated resilient means while the anodic work surface moves relative to such wiping blade. Preferably the wiping blade is mounted upon an adjoining cathode or even made a portion of the cathode structure, but it may also have an alternative means for mounting. The wiper blade or guide blade effectively removes bubbles of oxygen from an anodic work surface in the anodizing process. The solid wiper blades also effectively block the passage of a surface layer or film of electrolyte next to the anodic work surface when such surface and a surface film of electrolyte are moving together relative to the main body of electrolyte and causes replacement of such surface film with fresh electrolyte, thus preventing gradual or, in most cases, rapid heating of electrolyte. The use of the wiping blades also saves a large amount of energy by allowing closer spacing between the workpiece and the adjacent electrodes. In a preferred arrangement, the wiping blade is combined with a perforated cathode which allows ready escape of the overheated electrolyte layer adjacent the anodic work surface and replacement with fresh electrolyte. The blade also may serve very effectively as a guide blade to support flexible substrate material being anodized between more widely spaced support rolls or the like. The very thin restricted surface of the guide blade does not interfere with the anodizing operation and adjusts itself to any inequalities of the anodic surface as anodizing progresses.

The invention can thus be applied to anodizing by using the thin wiping blade to wipe bubbles of oxygen from the anode and also to continuously remove any overheated solution from adjacent to the anodic work surface as well as to stabilize the spacing between the anodic workpiece, or web, and adjacent cathodes to allow closer spacing between the electrodes and workpieces.

BRIEF DESCRIPTION OF THE DRAWINGS

FIG. 1 is a transverse cross sectional view of one arrangement for practice of the invention in an electroplating operation on rounds in accordance with the disclosure of a prior application of the present inventors.

FIG. 2 is a side view of one embodiment of the wiper blades shown in FIG. 1.

FIG. 24 is a cross-section through an alternative slidable wiper blade having a so-called "beaded" or round-headed design.

FIG. 25 is a cross-section through the beaded design of FIG. 24 mounted in a holder or track.

FIG. 26 is a cross-section through a related design and track for a wiping blade having a teardrop configuration.

FIG. 32 shows a transverse section of a flexible, resilient beaded blade with a surrounding track for use in arrangements such as shown in FIGS. 29 and 31 as well as FIG. 39.

FIG. 33 shows a transverse section of an alternative version of a headed blade taking the form of an L-section blade with a further alternative version of an L-section surrounding track for use in the arrangement shown in FIGS. 29 and 31 as well as FIG. 39.

FIG. 34 shows a transverse section of a still further alternative version of a modified brush-type wiping blade.

FIG. 35 is a side elevation of the modified brush-type wiping blade shown in FIG. 34.

FIG. 36 is a bottom view of the modified brush-type wiping blade shown in FIGS. 34 and 35.

FIG. 37 is an isometric view of a cathode assembly for supporting a combined upper cathode and wiping blade assembly using any of the wiping blade arrangements shown in FIGS. 24 through 26 or particularly, FIGS. 32 through 36.

FIG. 41 is an isometric view of a portion of a less preferred alternative type of wiping blade, i.e. a polymeric honeycombed wiper.

FIG. 42 is a diagrammatic transverse view of a coating line using an alternative wiping blade such as partially shown in FIG. 41.

FIG. 43 is a diagrammatic longitudinal elevation of the alternative type of wiping blade shown in FIGS. 41 and 42 mounted or in use on a coating line.

FIG. 44 is a diagrammatic side or longitudinal view of an improved embodiment of the invention shown in FIGS. 41 and 43.

FIG. 45 shows a top or plan view of an alternative version of a honeycomb or grid-type wiper having a thickness sufficiently restricted so that the structure is bendable into a curve or a coil.

FIG. 46 is a side section of the coilable grid-type wiper shown in FIG. 45.

FIG. 47 is an isometric view of an electroprocessing line making use of the form of flexible open or grid-type wiper shown in FIGS. 45 and 46, but having a grid pattern similar to that shown in FIG. 49.

FIG. 48 is a cross-section of FIG. 47 along the section line 48—48.

FIG. 49 is an alternative geometrical form of flexible open structural or grid-type wiping blade similar to that shown in FIG. 45, but with a diamond pattern similar to that shown in FIG. 49 rather than the square or oblong pattern shown in FIG. 45.

FIGS. 50 and 51 are two further alternative pattern geometrical forms of flexible open structural wiping blade similar to that shown in FIGS. 45 and 49, but with respectively generally hexagonal and triangular patterns rather than the square or diamond shapes shown in FIGS. 45 and 49, respectively.

DESCRIPTION OF THE PREFERRED EMBODIMENTS

Figure 3:
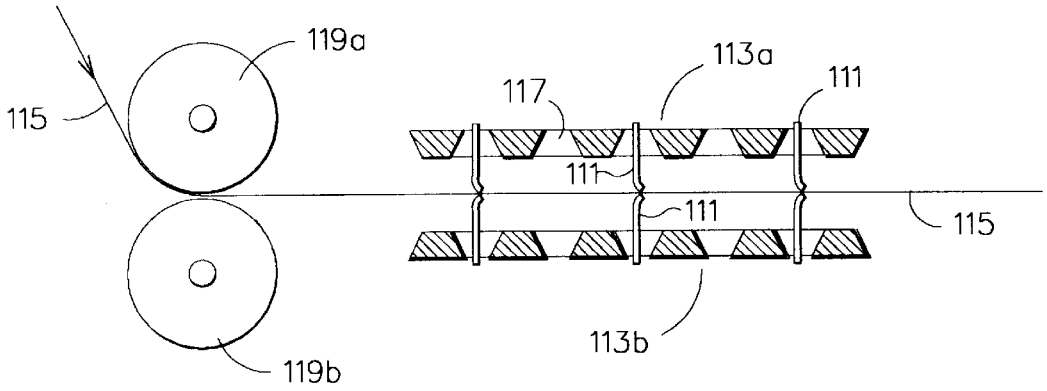
FIG. 3 is a diagrammatic partially sectioned side view of a portion of a continuous plating line showing the use of the dielectric wiping blades of the invention as disclosed in a prior application of the present inventors.

Various ways of removing hydrogen bubbles from the surface of a cathodic workpiece as well as oxygen bubbles from anodic workpieces and preventing electrolyte solution depletion have been developed in the past.

Likewise, it has been realized for many years that the rapidity and quality of electrochemical processing could be, at least theoretically, increased by spacing the processing electrodes as close to the workpiece surface to be coated or otherwise treated as possible. Where both the workpiece and the electrode are structurally rigid, the choice of such distance may be determined by the breakdown potential of the electrolytic solution. However, in the continuous coating of long lengths of sheet, strip, wire and the like, a further complication occurs in that the flexible material to be coated tends to oscillate, thus forcing the coating electrodes to be fairly widely spaced from the workpiece to prevent accidental arcing.

The present Applicants have discovered through careful experimental development that previous systems can be considerably improved and, in fact, superseded, by the use of a novel, basically solid wiping blade section having an extended wiping blade surface which resiliently contacts the work surface and lightly wipes and supports such surface along a relatively narrow line of contact.

In particular, in the anodizing of workpieces such as aluminum and other metal workpieces, including aluminum-coated steel strip and the like, a number of particular problems occur. One such problem is the collection of oxygen bubbles at or upon the surface of workpiece or strip. While the contact of the workpiece with oxygen, preferably in ionic form derived from the breakdown of water under the influence of an electrical current passed through the electrolyte used, usually an acid solution of some form to render the bath electrically conducting, is the basis of anodizing, the dissolved ionic oxygen tends to associate with itself to form gaseous molecular oxygen which forms essentially a barrier layer upon the surface of the workpiece interfering with the access to the surface of the dissolved ionic oxygen. The bubbles of oxygen also essentially insulate the workpiece surface from the anodizing current causing discontinuous oxidation of the surface. It is desirable, therefore, to prevent the collection of bubbles of molecular oxygen at the work surface. Various means for agitating the anodizing electrolyte have been devised for agitating the bath to carry away such bubbles of oxygen, but a really effective solution to the bubble problem has not heretofore been devised.

A second severe problem in anodizing has been severe heating of the surface of the workpiece due to resistance of the growing oxide layer on the surface to passage of electrical current. A metal oxide is essentially a non-conductor or dielectric, the resistance of which to the passage of electricity causes severe heating of the oxide layer itself as a current passes through resulting in severe heating of the adjacent electrolyte which may actually boil at the point it contacts the heated dielectric oxide layer. The thicker the oxide layer becomes, the more severe the heating problem becomes. Boiling of the electrolyte adds to the insulative effects and has other deleterious effects even further increasing the resistance and eventually stopping anodizing altogether. Heating of the electrolyte also decreases the efficiency of the process generally, the anodizing action proceeding most efficiently at a moderate temperature.

The partial solution to the heating problem has been to agitate the bath to increase transfer of heat away from the heated work surface and to cool the bath by circulating it through coolers or refrigeration units connected to the anodizing line. The difficulty with this is that the cooling does not take place near the site of the heat production and the heating is so concentrated and intense at its primary site that it is difficult to keep the site of heating cool no matter how much cooling capacity is applied to the electrolyte bath generally.

A further problem with anodizing as with other types of electroprocessing treatment of an elongated flexible material such as sheets and strips of metals generally is that, in general, the closer the electrodes are to the work surface, the less power is required generally and the more effective and efficient is the electroprocessing, and particularly electrocoating and anodizing up to the point at which the electrolyte fails in its capacity as a dielectric as opposed to its capacity as a current carrier in which case an arc may be drawn between a workpiece and an adjacent electrode. However, with flexible material it is not possible, in general, to support such flexible material too closely along its length with support rolls, since these interfere with electroprocessing of the surface of the workpiece, in the case of anodizing, blocking the surface of the workpiece from the electrolyte. Consequently, flexible material tends to oscillate from side to side transverse to its width and may touch or come close enough to adjacent electrode to cause arcing.

The present inventors have found that by the use of a thin flexible blade or a series of thin flexible plastic blades resiliently contacting the strip at spaced intervals along its length, all three of the above-noted problems are alleviated. Such thin plastic wiper blades wipe away bubbles of oxygen (or other gas) from the surface of the workpiece or strip preventing such bubbles in turn from interfering with access to the strip surface by ionic or dissolved oxygen in the electrolyte. Secondly, the flexible wiper blades serve very efficiently to wipe away from the surface of the strip the heated layer of liquid which tends to travel along with the strip and allow cooler liquid or electrolyte to contact the strip, thus not only preventing the electrolyte from boiling in contact with the strip, but, in general, cooling the strip itself and maintaining a cooler and thus more effective electrolytic medium for anodizing. Thirdly, the flexible plastic wiper blades very effectively stabilize the strip between support rolls keeping it from oscillating to any significant degree and thus preventing arcing and most importantly allowing the electrodes to be brought closer to the strip than would otherwise be possible. By allowing the electrodes to be more closely spaced to the workpiece or strip (frequently called the web in anodizing) much less voltage is necessary to attain the same current or current density (current per unit of area) than is otherwise possible. This results in a very substantial saving in power. Furthermore, it will be noted that not only are the electrodes enabled to be spaced closer to the strip surface, saving in power, but the removal of oxygen bubbles from the surface also results in less insulating of the strip surface resulting in still less power use. In addition, the general cooling of the portion of the bath or electrolyte through which the current passes also increases the efficiency of the anodizing process with a still greater saving in power required to operate the process at a given rate.

As the resiliently biased wiping blade passes either a cathodic coating surface, or an anodic work surface, it flexes upwardly or outwardly so that it rides easily over the surface being coated or over increasing coating weights or thicknesses of coating, if there is a recirculation of the coating surface under the same blade. In addition, the flexing or resiliency of the blade, which causes it to basically merely lightly contact the surface, prevents such blade from wearing rapidly. (Since an anodized coating essentially proceeds inwardly and is very thin in any event, the blades do not have to adjust to the coating in anodizing.) The contact of the dielectric blade with the surface of the material being coated is sufficient, however, to damp out oscillations of the material being coated and since the dielectric blades are preferably extended from the electrodes themselves, such blades serve very effectively to prevent the web or strip being coated from approaching sufficiently close to the electrode to cause an arc between them.

In a preferred arrangement of the coating blade, it may be attached to or closely spaced to a significantly locally discontinuous electrode, such as a cathode with fairly large or many small openings in it, a grid-type cathode or other discontinuous cathode which allows coating solution to flow through the cathode both away from the front of the blade as the surface heated layer approaches the wiping blade with cooler electrolyte flowing back behind the blade as such blade passes by. In this way, the solution next to the workpiece or strip is always being periodically changed.

The amount of pressure exerted upon the surface of the anodic workpiece by the end or side of the wiper blade, which is bent in the same direction as the passage of the work surface, is related to the thickness of the wiper blade in the section contacting the anodic work surface. The preferable nominal wiper blade thickness will be about 1/32 to 1/4 inch in thickness with a preferable range of about 1/16 to 1/8 inch and the distance of the cathodic workpiece surface from the electrode grid, may be between 1/16 inch to as much as 2 inches, but more preferable between 1/16 inch and 1 inch with a most preferably range of 1/4 to 3/8 inch. Consequently, the height of the wiper blade should be approximately 1/2 inch to 1.5 inches or thereabouts, depending upon the support arrangement, or in those cases where the spacing between the anodic surface and the cathode surface is greater than 1/2 inch, may be correspondingly greater. It is preferable, as indicated, to maintain a distance between the anodic or cathodic workpiece surface and the processing cathodes and anodes of not more than one inch, but the invention has been found effective up to as much as 2 inches, but over 2 to 3 inches the efficiency of anodizing in general decreases to such a low order that it is not worthwhile to consider use of the invention. The wiper blades may be tapered from top to bottom to increase the flexibility at the end of the blade in contact with the workpiece and in these cases the above thickness dimensions apply basically to the portion of the blade contacting the anodic work surface. The normal bearing of the wiper blade upon or against the surface of the anodic workpiece will, therefore, be rather light and insufficient to mar the surface, but sufficient to cause evolution of oxygen bubbles from the surface and also sufficient to effect or provide a significant guidance to the workpiece to prevent or damp out oscillations which might otherwise occur and cause effective contact between the anodic workpiece and cathode and thus arcing. The guidance and support provided by the blades enables the electrodes and workpiece to have closer spacing, and as a result, saves upon the energy necessary to effect a desired anodized coating upon the surface.

Since the wiper blades are very thin and preferably only the side of the end of the blade contacts the surface, only a minimum contact of the blade with the surface is involved so that a minimum interference with the anodizing process occurs. Furthermore, since the wiper blades are very thin, in any event, and are made from a dielectric material, such blades have a very minimum interference with the electrical field between the cathode and the anodic work surface and thus minimum interference with the throwing power of the electric field during the anodizing operation.

It has been found that the invention is applicable to the anodizing of metallic substrates in general, such as aluminum and other metals such as, for example, magnesium, copper, various aluminum alloys, aluminum-coated steel and the like. Such processes essentially make the workpiece anodic and drive oxygen from dissociated water onto the surface where it forms a corrosion resistant and decorative coating which may serve as the basis for the application of dye to the surface for coloring as well as various sealers. Very high charges are used in the process to drive the process and a great deal of hydrogen collects on the cathode and oxygen collects on the anodic workpiece which hydrogen gas also insulates the cathode from the anode and interferes with the anodizing process. The high currents also cause, as explained above, excessive heating of the electrolyte next to the anodic workpiece causing a further insulating phenomenon. This is caused by the growth of the thin oxide layer formed upon the anodic workpiece which oxide layer is, as explained, basically an insulator, which, as current is forced through it, rapidly heats, such as occurs in the burner elements of an electric stove. The thicker the oxide layer becomes, the more resistant to passage of current it becomes and the hotter it becomes until the adjacent electrolyte may actually boil, seriously interfering with the development of a satisfactory protective oxide layer or anodized surface. The wiping of the anodic workpiece in particular with moving wipers in accordance with the invention aids in reduction of the electrolyte heating problem.

FIG. 1 is a cross section of an apparatus for practicing the electrochemical processing in accordance with the present invention, as described in a previous application, particularly to attain a hard chrome coating on a cathodic workpiece. In FIG. 1, a shaft 11, having a surface or a portion of a surface to be electrolytically hard chromium coated is mounted within an outer plastic shell or housing 13 which is shown as having an upper half 13*a* and a lower half, 13*b*, connected by an appropriate hinge and clasp arrangement 14*a* and 14*b*, the details of which are not specifically illustrated. Such outer plastic shell 13 surrounds a substantially open electrolytic solution space 15 which extends between the shell 13 and the surface 29 of the shaft 11 to be coated. Within the electrolytic solution space 15 is mounted a grid-type electrode 17 comprised of longitudinal grid members 19 and transverse grid members 21. It will be seen that the longitudinal grid members 19 have been bisected in the cross sectional view of FIG. 1, while the transverse grid members 21 can be seen beyond the bisection plane.

The grid 17 is attached to bus bars 23 as shown in FIG. 1 through the intermediate electrode surface 25 and may also, if necessary, be supported at other places by insulated brackets, not shown. Mounted upon the electrode grid 17 at spaced points are so-called wiper blades 27, which are preferably mounted dependent from the anode and bear against the surface 29 of the shaft 11. The wiper blades 27 are formed of a flexible or resilient plastic material resistant to degradation by electrolytic solutions and arranged to bear upon the surface 29 of the roll 11 preferably on the side of one end of the plastic wiper blade. The top of the plastic wiper blade 27 is preferably fixed in the grid of the electrode 17 by essentially a snap action provided by pressing interconnecting snap sections 31 into appropriate orifices in the grid of the electrode 17 so that the upper portion of the wiper blade 27 is oriented towards the shaft 11, but is then deviated to the side by contact with the surface 29 of the shaft 11. The amount of pressure exerted upon the surface of the shaft as it rotates in contact with the end of the wiper blade, which is bent in the same direction as the rotation, is therefore related to the thickness of the wiper blade in the section of such blade extending from the surface 29 of the shaft 11 to the grid-type electrode 17. The preferable wiper blade thickness will be about 1/32 to 1/4 inch and preferably about 1/16 to 1/8 inch in thickness and the distance of the cathode surface from the electrode grid, as indicated above, may be between 1/16 to 2 inches and more preferably 1/8 to 1/2 inch or up possibly to 1 inch, with an absolute most preferred range of 1/4 to 3/8 inch, but preferably within the range of about 1/8 to 3/8 inch and preferably about 1/4 inch. Consequently, the length or height of the wiper blade should be approximately 1/2 inch to 1.5 inches or thereabout, depending upon the support arrangement, or in those cases where the spacing between the cathodic coating surface and the anode surface is greater than 1/2 inch, may be correspondingly greater. The normal bearing of the wiper blade upon or against the surface of the roll will, therefore, be rather light and insufficient to burnish or polish the surface, but sufficient to detach any dendritic material extending upwardly into the bath from the cathodic work surface, for example, in a chromizing operation, and to cause evolution of hydrogen bubbles from the surface. Such bubbles collect in the upper portion of the plastic housing 13 and may be discharged through hydrogen collection, or takeoff, pipes 30 at the very top of the casing 13.

The top of the coating blades shown in FIG. 1 may be made, or formed, as shown more particularly in FIG. 2. It will be seen in FIG. 2 that the upper portion of the wiper blade is formed into a series of expansion-lock or snap sections 31 having outwardly expanded tops 33, which may be jam-fitted into the openings between the longitudinal and transverse sections 19 and 21 of the grid-type anode 17. This construction allows the wiper blades to be quickly interlocked with the anode grid and to be simply and easily removed when the wiper blades 27 become worn and need to be replaced by new wiper blades. Normally the wiper blade 27 will be made by stamping out a series of the blades with the expanded top sections already formed upon them. However, it will be understood that various sections or shapes of the portion of the wiper blade which holds such blade in place may be formed depending upon how it is desired to attach the wiper blade to either the electrode, i.e. the anode, or to some other portion of the apparatus.

In FIG. 1, two electrolyte inlets 37 are positioned near the bottom of the coating chamber structure for passing fresh electrolytic solution continuously into the electrolytic chamber 15. Likewise, two outlets 39 are shown at the top where the electrolytic solution can flow from the electrolytic coating solution chamber 15.

It will be noted in FIG. 1 that the wiper blades 27 are spaced essentially at 90 degree intervals about the shaft 11. This has been found to be about right where the shaft rotates during coating at a fairly rapid velocity. However, in some cases, the blades might be spaced in pairs rather close together, so that the first blade wipes away or dislodges large bubbles and tends to coalesce smaller bubbles into larger, which are then immediately wiped away or dislodged by the second closely following blade. In such case, however, there will be at least one other set of wiper blades, either single or double, equally spaced about the shaft to aid in centering the shaft.

The invention has also been found very useful in the coating of continuous flexible material such as steel strip or sheet material in a continuous electrocoating line.

Figure 4:
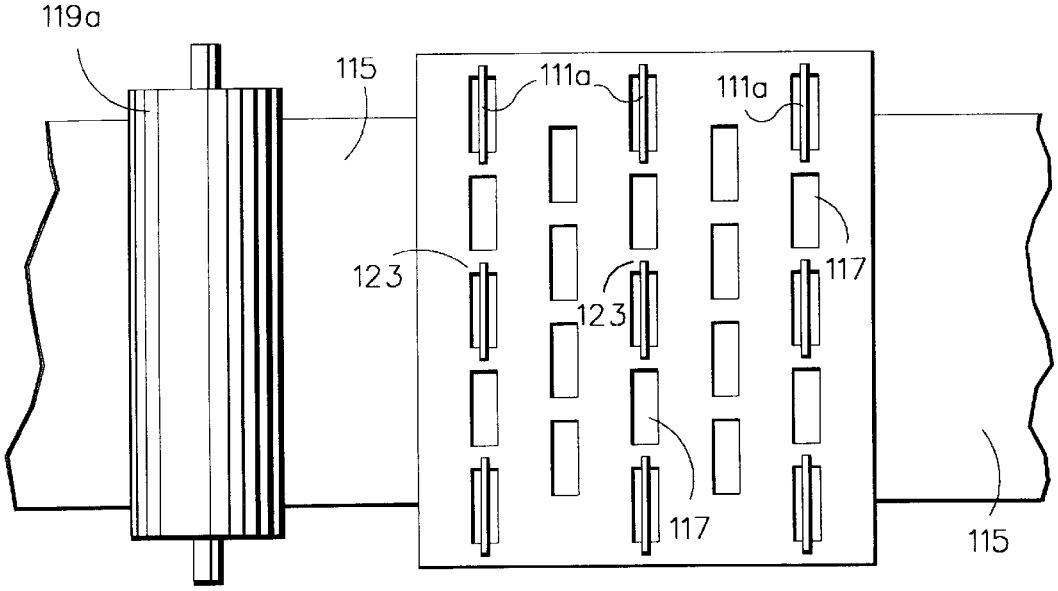
FIG. 4 is a diagrammatic top view of the portion of the continuous plating line shown in FIG. 3.

FIGS. 3 and 4 are diagrammatic side and top views respectively of a basic embodiment of the invention applied to electrocoating continuous strip again as disclosed in a previous application in which a series of wiping blades 111 like those shown in FIG. 2 are mounted in a pair of grid-type anodes 113*a* and 113*b* positioned on the top and bottom, respectively, of a continuous strip 115 which passes between two pinch-type guide rolls 119*a* and 119*b*.

The upper and lower anodes are perforated with openings 117 which allow for passage of electrolytic solution through them to reach the surface of the cathodic strip 115. The strip is guided by the guide rolls 119, only two of which are shown, and it will be understood there will normally be additional guide rolls as well as anodes beyond those shown. The ends of the wiper blades 111 are flexed against the surface of the strip as shown so that a light pressure is exerted against the strip, aiding in guiding it as well as wiping bubbles of hydrogen from the strip surface. The guide rolls 119*a* and 119*b* are customarily mere idler rolls and in many cases the idler roll 119*b* may be dispensed with. It will be recognized that FIGS. 3 and 4 show essentially a stretched out or planar form of the circumferential anode arrangement shown in FIG. 1. The rectangular openings 117 are, as shown, preferably staggered or overlapping so that any given portion of the strip surface will not pass adjacent to a series of openings while adjacent portions pass always adjacent to solid portions of the anode, but will alternate regularly between open and solid sections of the anode. The dielectric wiper blades serve not only to wipe hydrogen bubbles from the coating surface and to interrupt passage of a depleted surface layer of electrolyte along the workpiece, but also aid in centering the workpiece within the anodes to prevent the surface of the anodes and the surface of the workpiece from too close approach and possible arcing with consequent damage to both the workpiece and the anode.

FIG. 4, as explained above, shows an overlapping or staggered pattern of orifices or openings in the perforated anodes so that instead of such electrodes 113*a* and 113*b* being orientated generally in the direction of the movement of the continuous strip through the apparatus, the openings are displaced transversely of each other. This ensures a continuously changing coating pattern as the cathodic workpiece passes between the grid-type electrode and tends to prevent differential coating thicknesses on the strip surface. The present inventors have found that by the use of their dielectric material wiping blade, they are able to not only efficiently wipe hydrogen bubbles from the cathodic coating surface as well as effectively sever dendritic material extending from the surface in the case of a thicker coating, and also to very effectively wipe any surface layer of partially depleted coating solution from the coating surface, thus effectively preventing depletion of the coating solution next to the cathodic coating surface, but in addition by the use of their wiping blades, are enabled to steady or guide the strip traveling past the anode and thus prevent too close an approach and arcing between the anode and the strip. By the use of the thin dielectric blade of the invention serving as a guide blade, therefore, closer spacing of the anodes to the continuous strip may be had with a resultant increase in throwing power.

Figures 5A, 5B, 6, 7, 9, 10:
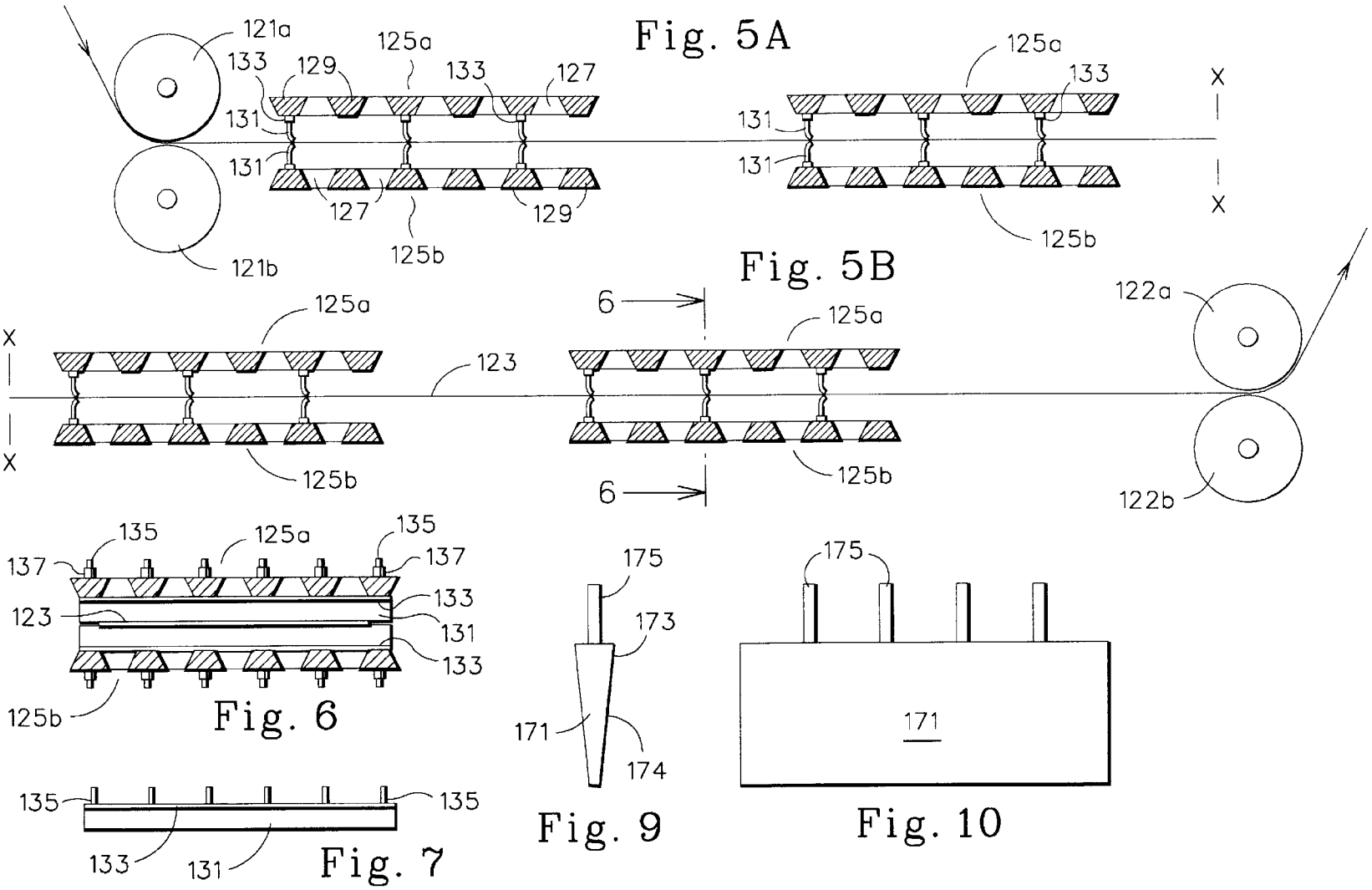
FIGS. 5A and 5B are diagrammatic partial longitudinal sections of a continuous plating line equipped in accordance with the invention with an alternative form of the wiper blade of the invention as disclosed in a prior application of the inventors.
FIG. 6 is a transverse section through the portion of the continuous coating line of FIG. 5B along section 6—6.
FIG. 7 is an enlarged view along the length of one of the wiper blades used in the continuous coating line shown in FIGS. 5 and 6.
FIG. 9 is an end view of an alternative tapered wiping blade in accordance with the present invention.
FIG. 10 is a side or longitudinal view or elevation of the tapered wiping blade shown in FIG. 9.

FIGS. 5A and 5B are diagrammatic side elevations of a so-called tin-free steel, or "TFS" line, for coating blackplate with a thin, almost flash coating of chromium plus chromium oxide. The chromium oxide is usually applied in a different cell or tank. Guide rolls 121*a* and 121*b* and 122*a* and 122*b* convey a strip 123 of blackplate, i.e. uncoated steel strip or sheet material, straight through a tank, not shown, in which the coating operation is confined in a body of electrolyte between pairs of anodes 125*a* and 125*b* formed in a grid configuration with longitudinal elements 127 and transverse elements 129 shown in section. As shown, the individual members or elements of the grid-type electrode have a truncated triangular shape slanted toward the strip surface and providing additional surface area to increase the anode surface area exposed to the electrolytic solution particularly in the direction of the workpiece or strip surface, assuring at least a 1.5 to 1.0, or greater, anode to strip surface ratio. The top anodes 125*a* and bottom anodes 125*b* are spaced within about one half to three quarters of an inch of each other with the strip 123 passing between them. Alternating transverse elements of the anodes are provided with resilient plastic wiper blades 131 which are attached to or mounted upon such transverse elements as shown, by essentially threaded plastic fittings, but could be mounted in the openings of the grid equally well, as shown in FIGS. 3 and 4. As in the previous views of other embodiments, the wiper blades are slightly longer, or wider, than the space between the strip surface and the anode surface so that the blade is partially flexed during continuous plating operation. It is believed preferable for the blade to be flexed just sufficiently to enable its end or side to ride upon the surface to be coated along one edge. In other words, the wiper is preferably cut straight across at the bottom so that when flexed, it rides with an edge or corner of one side against the strip surface and wipes off all bubbles of hydrogen as well as any thin cathodic layer which tends to form. The coating in a continuous coating line is not usually sufficiently thick for dendritic material to begin to grow or extend from the surface. However, if the electrolytic coating is one upon which dendritic material tends to grow from the surface, the edges of the blades also very neatly shear off such dendritic material so it does not interfere with the uniformity of coating. However, as noted, in the coating of continuous black plate or cold rolled steel strip, the coating usually is not allowed to become thick enough for any dendritic material to form. The principal function of the wiping blade, therefore, in the process shown in FIGS. 5A and 5B and 6 is first to detach bubbles of hydrogen from the coating surface, second to divert any thin electrolyte depletion layer or film that may otherwise tend to travel along with the strip and third, to offer resistance to oscillations of the strip or to guide the strip between the coating electrodes. Thus, as a thin surface layer of electrolyte travels through the apparatus with the strip, such surface layer impinges upon or contacts the stationary wiper blade, which is resiliently held against the strip with sufficient force to prevent the blade from being displaced or lifted away from the strip by the force of the electrolyte being carried or dragged along with the moving strip, but not with such force that it will not be easily lifted by the coating building up on such strip in order to prevent the coating from being damaged by the wiper blade. The stationary wiper blade thus diverts or displaces away from the surface of the strip the thin layer of partially or fully depleted electrolyte that is usually carried along with the surface of the moving strip. The displaced layer of coating solution is displaced not only sidewise along the blade, but also partially upwardly through the openings in the anode grid in front of the wiper blade. At the same time, fresh solution enters the space between wiper blades from the sides and also from the top through the openings in the electrode grid behind the blade. If the anode is more than a few inches wide, the entrance of electrolyte from the side would not be sufficient to prevent cavitation or temporary and fluctuating open spaces behind the blade and it is, therefore, important that the wiper blade be used in combination with a perforated anode, particularly as the opening or clearance between the perforated anode and the metal substrate or strip is only on the order preferably of about one quarter to three eighths of an inch in order to attain maximum efficiency. The thin dielectric flexible or resilient blade also very effectively stabilizes the position of the strip with respect to the anodes.

The wiper blades 131 are shown in FIGS. 5A and 5B as having an upper mounting or flange 133 into which they extend or which is integral with the blade itself and such upper mount is then attached, preferably directly to the anode, by threaded fasteners which may pass through fastening openings in the anode and may be secured with a threaded nut. It is preferred to have the upper mounting 133 made from the same electrolyte-resistant dielectric plastic, such as, for example, polypropylene, and to have the threaded fastener 135 in the form of a stud made from the same plastic material or other plastic material which may be threaded into the upper mounting block on one end and have the other end passed through an orifice in the lead or other composition anode, such as titanium, and secured by a threaded nut 137 as shown most clearly in FIG. 6.

Figure 8:
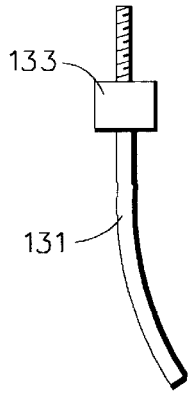
FIG. 8 is an enlarged end view of the wiping blade shown in FIG. 7.

FIG. 6 is a cross section transversely through upper and lower grid-type electrodes 125*a* and 125*b* as well as the strip 123 along the section 6—6 in FIG. 5B showing the wiping blades of the invention bearing upon the surface of the strip, while FIG. 7 is a side view of one of the wiper blades by itself prior to being affixed in place or secured to one of the anodes as shown in FIG. 6. FIG. 8 is an enlarged end view of the wiper blade 131 and mounting 133 shown in FIG. 7 by itself and shown in FIG. 6 mounted in place in the coating tank, not shown. The coating wiping blade 131 is illustrated in FIG. 8 with the minor flexure which is preferred when the blade is in operative position against the strip, but it should be recognized that the blade will normally, when free standing by itself be straight rather than flexed so that when it is contacted against a surface to be coated, it will exert a small but definite back force against the surface to be coated. Such force should be sufficient, as noted above, to thoroughly remove as well as coalesce hydrogen bubbles clinging to such surface and, it is believed, nucleate into small hydrogen bubbles any cathodic film clinging to or laid down upon such surface. In addition, in the case where there is dendritic material forming upon such surface, the force of the blade should be sufficient to sever, shave off or otherwise remove such dendritic material, while at the same time not bearing upon the surface sufficiently to prevent buildup of the coating and/or to burnish or damage the coating. The degree of force should also be sufficient to prevent the surface layer of liquid electrolyte drawn along with the moving strip from lifting the wiper blade from the surface as the result of the force building up in front of and under the blade, since this would allow the potentially partially depleted surface layer of electrolyte normally drawn along with the strip or other workpiece to pass at least partially under the blade to the opposite side of the wiper blade, rather than being diverted from the surface and replaced by fresh electrolyte flowing in behind the blade as the strip passes under the blade. The wiper blade or dielectric guide blade should also be sufficiently flexible, as explained, to resiliently support the material being coated against transverse oscillations and other movement allowing closer spacing of the anodes to the cathodic workpiece along wider stretches between actual guide or support rolls which otherwise decrease actual electroplating space. The parameters of the resiliency of the blade, therefore, are essentially the generation of sufficient force, due to resiliency either of the plastic itself or of a separate resilient biasing means, to prevent any substantial escape of liquid electrolyte under the blade and to sever thin dendritic processes, if any are present, and to guide and prevent oscillation of the cathodic workpiece, but not sufficient to mar the coated surface or to prevent the necessary buildup of an electrolytic coating of the thickness desired upon the surface. A blade which will resist lifting by the surface layer of fluid will usually also be effective to remove bubbles of hydrogen as well as nucleate smaller quantities of hydrogen into bubbles. An immovable, or non-resilient, blade would simply constrict any upward buildup of coating, a very undesirable situation. An immovable blade would also rapidly wear. The resiliency should also be sufficient to prevent or damp out any substantial oscillation or weaving of the strip between the sets of guide rolls 121 and 122 in a continuous coating line such as shown in FIGS. 5A and 5B and prevent possible touching and arcing of the cathodic workpiece or strip with the anode. Arcing can, of course, also occur if the anodic and cathodic surfaces approach close enough for the potential between the two to break down the natural resistance of the intervening electrolyte except by ion transport of the electric current. It is for this reason also that the wiping blade itself should not be a conductor of electricity or have a low dielectric value and should be sufficiently stiff to provide substantial and effective guidance and directional stability to the workpiece, particularly when in the form of a flexible strip or the like.

While it is preferred to rely upon the resiliency of the narrow, thin wiping blade itself to produce sufficient force to prevent lifting of the blade from the surface of the workpiece by the force of the electrolytic solution upon side of the blade and to maintain the strip centered between the electrodes, other resilient arrangements to accomplish basically the same end may be used.

FIGS. 9 and 10 are end and side views, respectively, of a tapered wiping blade 171 in which the top portion 173 of the blade is expanded in size and preferably has a series of thin pins 175 extending from it. This blade can be attached to an anode by inserting the pins 175 into pre-drilled holes in adjoining anodes and when it is desired to replace a blade, such blade can be easily pried out of its mounting with a prying tool of proper design and a new blade popped into place. The lower portion 174 of the blade 171 is tapered so that it is properly flexible or resilient to bear against the surface of the coating substrate or strip and may be preflexed, if desired, in the proper direction. As may be seen, the tapered blade 171 shown in FIGS. 9 and 10 is essentially similar to the rectangular cross section blade shown in FIG. 8 in which the profile of the blade is extended upwardly from the thin flexible tip to the outer ends of the mounting or top section 133 of the blade.

Figure 11:
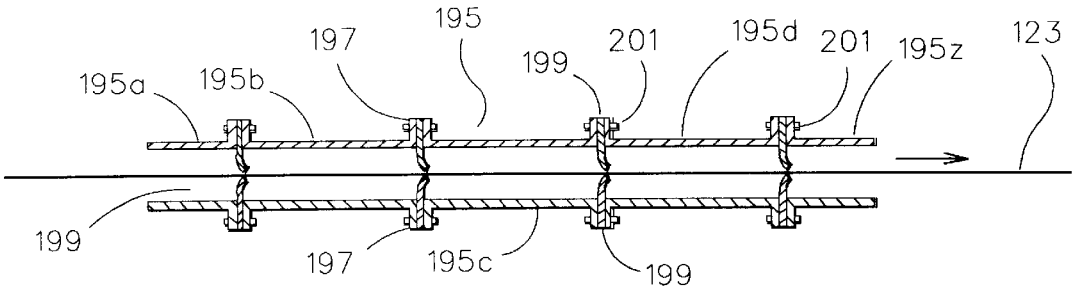
FIG. 11 is a diagrammatic side view of a series of resilient wiper blades mounted in a sectionalized anode for use in continuous electrolytic coating of a sheet or strip in accordance with the inventors' previous application.
Figure 12:
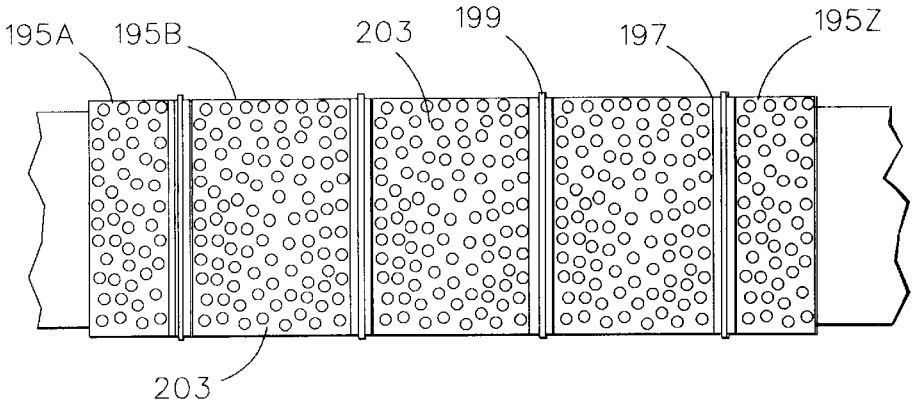
FIG. 12 is a plan view of the top of the sectionalized anode and resilient wiper blade arrangement shown in FIG. 11.

In FIGS. 11 and 12 respectively, there are shown a diagrammatic side elevation and a diagrammatic plan view of a perforated anode and plastic wiping blade combination construction for use in the continuous plating of strip or sheet. As shown, a single anode 195 may be divided or sectionalized, for example, into four more or less equal sized sections 195*a*, 195*b* and so forth with upstanding flanges 197 between the sections between which dielectric wiper blades 199 are mounted and secured by the same fastenings as secure together the flanges. Such flanges 197 and wiper blades 199 are thus connected or secured together by means of fastenings 201, which may be threaded or other suitable fastening. Additional anode sections may extend on either side of those shown in the figures to form whatever sectionalized anode length is convenient or desirable. The lengths of the anode sections 195*a*, 195*b* and so forth are preferably equal and are arranged so that the wiper blades 199 are positioned opposite to each other along the strip 123. Such lengths may typically be 6 inches to 12 inches. The sectionalized arrangement not only provides an integrated structure, but a stronger structure overall, and if the wiping blades are slotted, allows such blades also to be adjusted periodically for wear, although as noted, wear is generally not very rapid because of the flexibility of the blades. The wiping blades can also be reconditioned by use of a special reconditioning tool which can shave off worn or contaminated surfaces of the wiping surface of the blade. Each anode section is provided with a plurality of more or less randomly, but closely spaced orifices 203, best shown in FIG. 12, through which coating solution may have free passage, particularly, as explained above, as the wiper blades 199 force a surface layer of solution away from the surfaces of the traveling strip 123. As explained previously, such solution will be forced by the movement of the strip past the wiping blade out the sides of the spaces between the anodes and the workpiece between the blades, but also up through the anode orifices in front of the blade, while other solution passes through the orifices at the back of the wiping blade as well as in from the sides to take the place of the previous solution, thus ensuring a continuing renewal of the electrolytic solution next to the surface of the workpieces.

As in earlier figures, the wiper blades are shown inclined slightly in the direction the workpiece surface is moving. Preferably one edge of the end or side of the wiper blade contacts the surface of the workpiece. This very effectively strips the barrier layer of solution and hydrogen bubbles away from the surface of the moving substrate.

Figure 13:
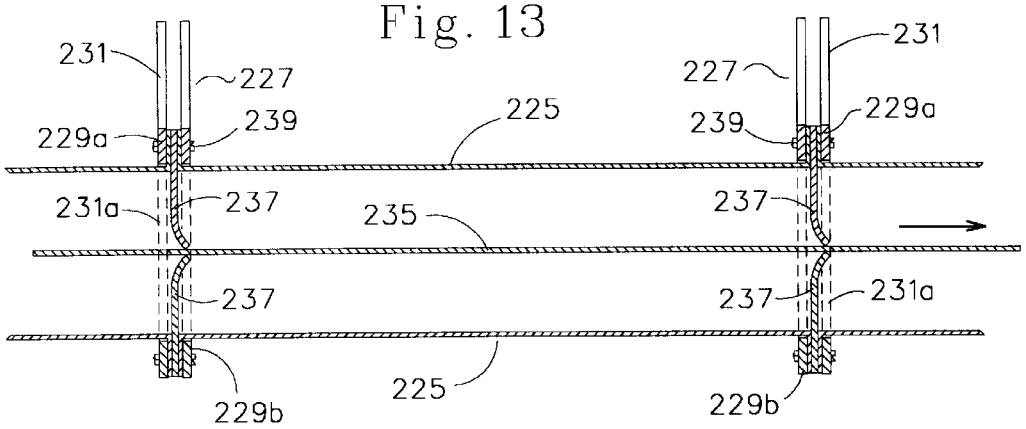
FIG. 13 is a diagrammatic side view of one embodiment of the electrode and wiper assemblies similar to that shown in FIGS. 11 and 12 in use on a continuous electroplating line.

In FIG. 13, two separate hangers or support pieces 227 cooperate to support adjacent sections of sectionalized anodes. This provides a balanced structure with, as shown, each cross piece 229 of the hangers 227 having a flange of the anodes 225 passed upwardly along the inside of the cross piece 229 and directly contacting the top of the wiping blade 237 between the two flanges. Alternatively, the flanges of the anodes 225 may be turned up and secured to the outside of the cross pieces 229. However, this, in effect, slightly reduces the length of the anode section, which is undesirable. Only one hanger can also be used at each intersection and in this case it will be desirable to bring the flange of one anode section under the hanger and secure it to the opposite side, secure the wiping blade against this flange of the anode and secure the flange of the adjoining anode against the opposite side of the wiping blade, thus gaining maximum length of the anode sections, but a somewhat less secure mounting for the wiping blade, particularly when consumable electrodes are being used. In FIG. 13, the vertical portion 231*a* of the hangers 227 passing between the two crosspieces 229*a* and 229*b* are shown in dotted outline.

In those cases where consumable electrodes are being used in an electroplating operation, certain more or less inert inclusions may be contained in the electrode that could be released from such electrode which anode materials upon dissolution of the electrode could result in contamination of the bath. In such cases it is frequent practice to surround or encase the electrodes in a filter bag formed from a plastic resin material such as polypropylene or the like. Such filter bag contains or retains such insoluble impurities and prevents them from being released to the bath where they might contaminate or mar the coated strip surface.

The embodiments of the invention shown in FIGS. 11, 12 and 13 will be recognized to provide a very practical and effective embodiment or embodiments of the invention which are easily supported in position in an electroplating bath at the proper distances from a strip passing through the bath. Furthermore, as will be recognized, the dielectric spacing blades or wiping blades 199 and 237 effectively guide the strip 123 and 235 between the electrodes 195 and 225 and maintain the strip spaced at the correct distance from the electrodes. The fairly close spacing, typically 6- to 12-inch intervals, of the multiple wiper blades 199 and 237 along the length of the anodes effectively guides the strip between the electrodes 195 and 225 preventing deviation of the strip and damping out oscillations in such strip which might cause it to approach closely enough to the anodes 225 to strike, or otherwise induce, an arc between the anodes and the strip. However, because of the very thin structure of the wiper blades, such blades do not interfere significantly or at all with the coating of the strip either in the vicinity of the blade or even underneath the blade, while the flexibility or resilience of the blade prevents such blade from wearing, except rather slowly. The blades 237 moreover very effectively immediately dislodge bubbles of hydrogen from the cathodic film which tends to build up on the surface of the cathodic workpiece 235.

DESCRIPTION OF INVENTION APPLIED TO ANODIZING

FIGS. 1 through 13 discussed above and found also among other similar figures in previous applications of the present inventors describe the invention broadly as applied particularly to electroplating of various metallic coatings upon metallic substrates. Such electroplating has been claimed particularly in such prior applications. The present inventors have now found, however, that their basic apparatus and method has broader application and can, in fact, be applied to other types of electrochemical treating operations and particularly to anodizing. The operation and use of the invention in anodizing is very broadly similar to its use in electroplating except that in anodizing the workpiece is the anode and the adjacent electrodes are cathodes. In addition, the gas which occludes the workpiece surface in anodizing is oxygen rather than hydrogen, although hydrogen may be a problem at the cathode. Also, since an oxide is a dielectric which takes significant energy to drive a current through and the electrolyte is not depleted during anodizing, but instead heated severely at the interface with the anodizing coating, the problem with a layer of electrolyte being pulled along with the strip is that of heating severely the immediate electrolyte rather than depleting the electrolyte. However, the problem is still that a thin layer of electrolyte is being drawn along with the strip or workpiece and the wiping blades of the invention have been found to be eminently effective in deflecting this heated layer away from the strip in the same manner as a depletion layer. Furthermore, in anodizing, just as in electroplating, it is desirable to space the electrodes as close to the surface of the workpiece as possible and the stabilizing action of the thin plastic wiping blade is equally effective in stabilizing a flexible strip being anodized as a flexible strip being electroplated and, therefore, in allowing the surrounding electrodes to be brought as close as possible to the strip surface with a very major saving in energy. Study of the descriptions accompanying the foregoing FIGS. 1 through 13, therefore, will provide a very basic outline of the invention which will materially aid in understanding the application of the invention to anodizing as disclosed in the following figures and explanation.

Figures 14, 15:
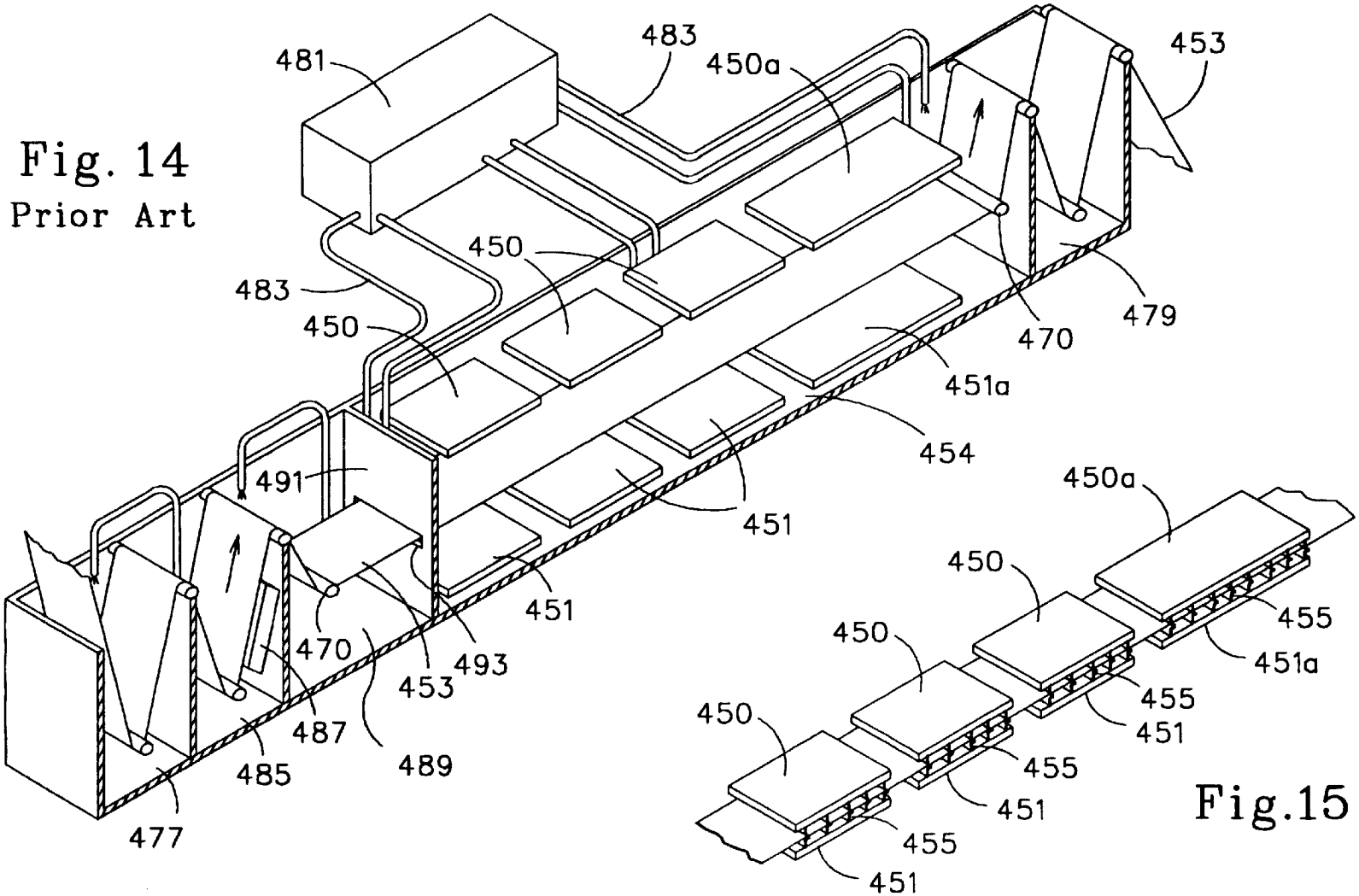
Fig. 14 Prior Art
FIG. 14 is a diagrammatic isometric view of a typical continuous anodizing line for the anodizing of a steel strip.
FIG. 15 is a diagrammatic isometric view of a portion of a continuous anodizing line such as shown in FIG. 14 showing flexible plastic wiping blades in accordance with the present invention applied to such line.

FIG. 14 is a partly broken-away isometric view of a typical prior art continuous anodizing line which includes typically a series of electrodes or cathodes 450 and 451 mounted above and below a strip 453 which passes over guide rolls 470 at both ends of the anodizing tank section 454 of the operation. It is frequently the practice in anodizing lines to have a series of physically separate cathodes mounted at intervals above and below the strip often with decreasing spacing between the adjacent cathodes in a longitudinal direction within the anodizing tank section of the line. In FIG. 14, the last set of cathodes 450*a* and 451*a* are longer than the preceding electrodes in the anodizing section. The anodizing section of the line is preceded usually by a cleaning section tank 477 and followed by a sealing section 479 and then a rinse station, not shown. A cooler 481 is attached to the electrolyte tank to continuously cool the electrolyte which is continuously recirculated by a series of conduits 483.

A so-called contact cell 485 where the strip or web is initially immersed in electrolyte and rendered anodic by induced current either through a charge on the walls of the tank, by grids, not shown, spaced from the web, or, in the case shown, by a lead or graphite anode 487 which is connected to the positive terminal of a power source, not shown, the negative terminal being connected to the cathodes 450 and 451, such conventional connections also not being shown. In some installations, actual contact rolls are provided to initially render the web anodic. However, contact rolls must contact the strip while dry and tend to arc when the strip separates from the roll with resultant burning of the surfaces of both.

A so-called baffle section 489 of the anodizing tank first introduces the strip or web to the electrolyte in the anodizing section separated by a baffle 491 with a slit 493 for entrance of the web to the main section of the anodizing tank 454 where the cathodes 450 and 451 are adjacent to the strip. A uniform very thin layer of oxide is started on the web in the baffle section 489 before the web is exposed directly to the cathodes in the main anodizing section where the current builds up a heavier oxide coating.

FIG. 15 is a diagrammatic isometric view of a section of an anodizing line such as shown in FIG. 14 wherein the four cathodes 450 and 451 have been provided with spaced flexible wiping blades 455 essentially as previously shown, except, as will be noted, the cathodes 450 and 451 can now be placed much closer to the strip or web 453 due to the stabilizing effect of the flexible wiping blades. The electrodes 450 and 451 are not perforated so the wiping blades 455 have to flush the electrolyte out between the ends of the blades. However, just as in electroplating where it is desirable to perforate the anodes, in anodizing it is also desirable to perforate the cathodes as further shown in FIG. 16, which is essentially the same as FIG. 15, except that it shows perforations 452 in the cathodes to aid in circulation of the electrolyte, particularly as it is wiped away from the surface of the anode or workpiece. As explained above, the flexible wiping blades continuously wipe bubbles of oxygen from the surface of the strip facilitating passage of current by maintaining continuous contact of the electrolyte and its content of ionic oxygen with the surface being anodized. The wiping of the work surface also removes or strips away electrolyte from the surface and expels it both from the sides of the strip and also through the orifices in the cathodes 450 and 451 and the blades also tend to steady or stabilize the strip between the cathode preventing it from flexing too much and touching the cathode causing arcing.

Figure 16:
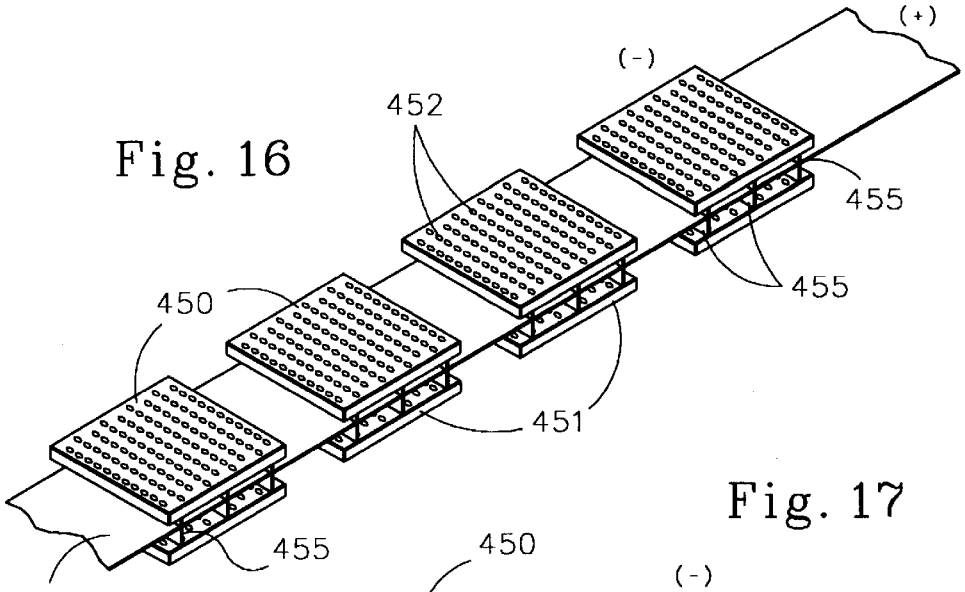
FIG. 16 is a diagrammatic isometric view of a portion of a continuous anodizing line such as shown in FIGS. 14 and 15 showing the flexible plastic wiping blades in accordance with the present invention extending from the perforated cathodes in such line.

FIG. 16 is, as noted above, a diagrammatic isometric view of a typical anodizing section of an anodizing line showing a series of upper cathodes 450 and opposed lower cathodes 451 between which passes an aluminum or other anodizable extended metal section, or workpiece, frequently referred to in the anodizing art as the "web", which may be sheet or strip material, foil or other gauges of aluminum material. It will be understood that the "web" material will be passing through an electrolyte typically held in a tank, not shown. The electrolyte may be a 10 or 15 percent solution of a strongly ionized acid such as sulfuric acid, chromic acid or dibasic or organic acids such as oxalic acid or the like, or mixtures of various acids. The electrodes may be any metal not readily dissolved by the electrolyte. The electrodes are made cathodic by being included in a suitable circuit, usually, but not necessarily, a direct current circuit and the web material is rendered anodic either by contact rolls at another portion of the line or by passage through so-called contact cells where electrons are removed from the web through an electrolyte to leave the web effectively anodic. Appropriately charged electrodes which may be of various kinds such as grids and solid electrode members positioned adjacent the web just before the actual anodizing section are conventionally used for this purpose, as explained above.

Figure 17:
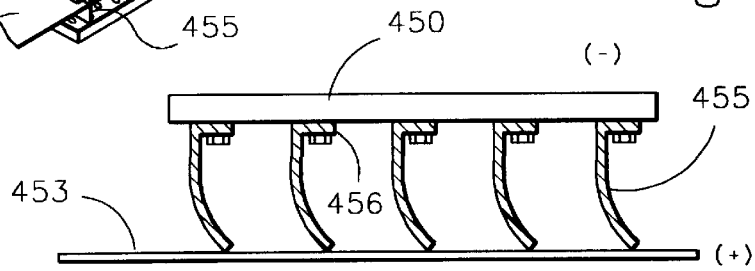
FIG. 17 is an enlarged side view of an arrangement of flexible wiping blades in accordance with the invention secured to a cathode in an anodizing arrangement such as shown in FIGS. 15 and 16.
Figure 19:
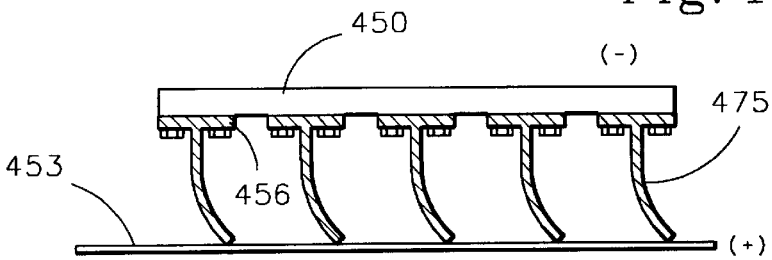
FIG. 19 is an enlarged side view of a series of T-blades secured to a cathode in accordance with the invention in use on an anodizing line such as shown in FIGS. 14 and 16.

Mounted upon the electrodes or cathodes 450 and 451 in the anodizing section of the anodizing line shown in FIGS. 15 and 16 are flexible wiper blades 455 which may be any of the flexible wiper blades disclosed in previous figures for use in electroplating operations or may very practically be of the type shown in FIG. 17 which comprises a series of L-type blades secured to the surface of the electrode by suitable screw-type or other fastenings. Another similar arrangement using T-shaped flexible wiping blades is shown in FIG. 19.

Figure 18:
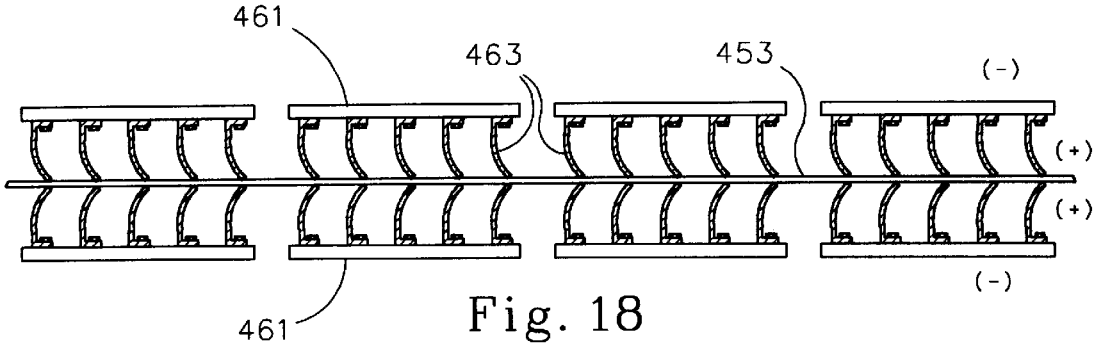
FIG. 18 is a diagrammatic side view of a series of wiping blades of the type shown in FIG. 17 in use on an anodizing line such as shown in FIG. 12.

FIG. 18 is a side view of the anodizing section of an anodizing line such as shown in FIG. 16 showing a series of upper and lower cathodes 461 with flexible wiper blades 463 secured to their surfaces and contacting an anodic strip 453. As indicated above, the cathodes shown in FIG. 16 are perforated with orifices 452 to allow the heated electrolyte wiped from the surface of the anodic web 453 to be freely expelled not only from the open sides of the electrodes, but also through such orifices 452 to be replaced by cooler electrolyte from other sections of the electrolytic bath. Anodizing cathodes do not normally use the additional ratio of surface area of electrode over area of strip to be treated, however, and the orifices can less preferably be dispensed with, as shown in FIGS. 15 or 38C.

Figure 20:
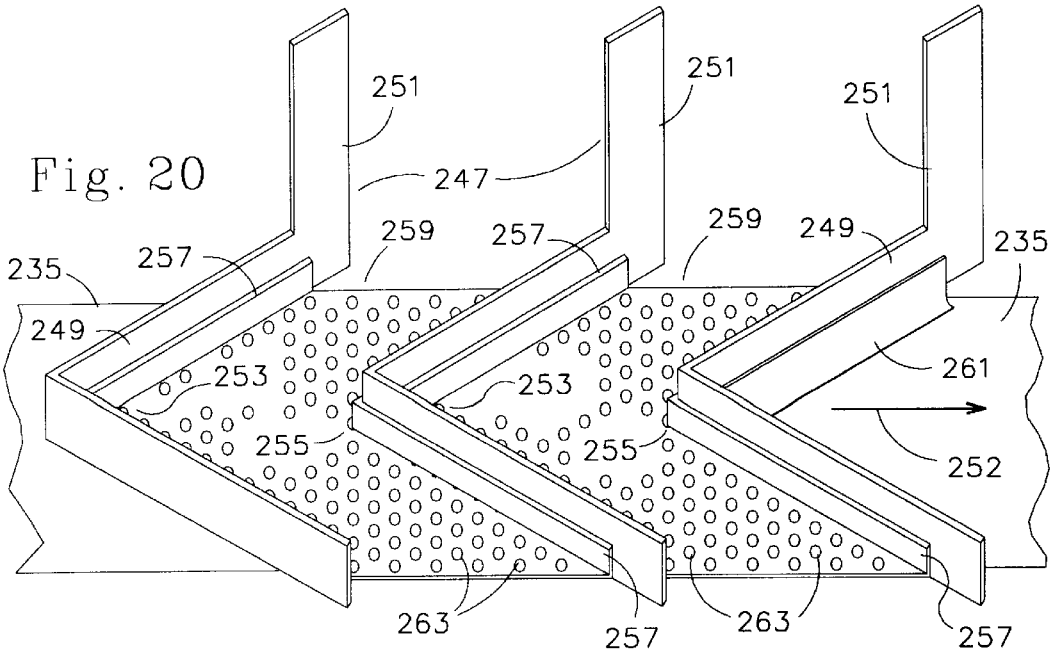
FIG. 20 is a diagrammatic oblique view of an alternative wiping blade arrangement in accordance with the invention.

FIG. 20 is an oblique view of a preferred chevron-type flanged cathode arrangement in which hangers 247, as a whole, and including particularly a horizontal support section 249 having a triangular or chevron shape. A vertical support 251 is provided on one side of each one of the chevron-shaped hangers 247. Each perforated cathode 259 has a shape essentially of a rather fat arrow having a pointed leading end 253 pointed in the direction from which the strip approaches and a rear end having a V-section 255 pointing likewise in the direction from which the strip approaches and open toward the direction in which the strip moves away from the anode. The direction of movement of the strip is indicated by arrow 252. Flanges 257 on the perforated anodes 259 serve to provide a structure by which the perforated anode sections are secured to the horizontal supports 249 of the hangers 247. Flexible resilient wiping blades 261 are held rigidly in place upon the crosspieces or horizontal supports 249 or against the flanges 257 to provide a light brushing action upon the surface of the strip. Orifices 263 are provided in the perforated anode. It has been found that the wiping blades 261 having the chevron shape are particularly effective at sweeping the thin layer of electrolyte which is normally carried along with the strip 235 and removing or urging such electrolyte towards the sides of the strip allowing new electrolyte to flow in through the perforations 263 in the perforated anode 259. In this way, fresh cooled electrolyte is at all times being fed to the surface of the strip. In addition, it has been found that the chevron or V-shaped wiping blades are particularly effective in preventing oscillations of the strip surface which might cause the strip to approach the closely spaced cathode such that arcing between the cathode and the anodic strip surface may take place, damaging both structures. As may be seen in FIG. 20, for example, the leading section or point 253 of a following flanged anode may approach rather closely or even overlap an imaginary line connecting the ends of the V-section of an earlier or preceding anode in the direction in which the strip is passing so that the strip surface is supported against substantial oscillations, not only longitudinally, but also transversely of the strip. The flanges 257 are secured in any suitable manner to the horizontal portions 249 of the hangers 247, which horizontal or cross-support sections preferably continue or extend out from the side of the actual cathodes at an angle providing further movement or agitation of the electrolytic liquid within the area of but extending to the side of the cathode. The perforations 263 in the surface of the cathode 259 preferably have an overlapping or staggered pattern.

Figure 21:
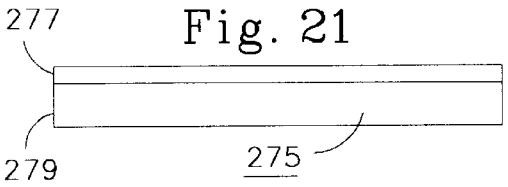
FIG. 21 is a side elevation of an elongated longitudinally movable or slidable T-shaped or section wiping blade in accordance with the invention.
Figure 23:
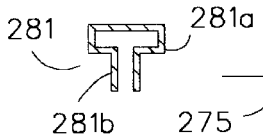
FIG. 23 is an end view of a holder or track for the T-shaped blade shown in FIGS. 21 and 22.
Figure 22:
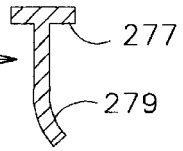
FIG. 22 is a cross-section through the elongated wiping blade shown in FIG. 21.

FIG. 21 is a side view or elevation of a somewhat different type of resilient wiper blade having an extended T-shaped configuration, which, as will be explained, may be fed across an anodizing line continuously or discontinuously as such wiper blade wears so that the anodizing line will not have to be stopped in case of wear of the various wiper blades to secure or mount new blades between the flanged sections of the cathode or cathodes. An end cross section of the T-blade is shown in FIG. 22 and a cross section of a flanged blade securing holder or T-section holder is shown in FIG. 23. In FIGS. 21 and 22, a T-shaped blade 275 is shown having an upper section 277 which constitutes the crosspiece of the "T" and a lower section 279 which constitutes the flexible blade itself. The crosspiece 277 provides a structural portion of the blade.

In FIG. 23, a combined holder and T-flange channel 281 is shown which takes the shape generally of the T-blade 275 itself with sufficient inner dimensions to allow the T-blade to pass within and through it. The track or holder 281, like the T-blade itself, has an upper cross-T-section 281*a* and lower section 281*b*.

In FIG. 24, there is shown an end section or cross section of a modification 275*a* of the T-section blade shown in FIGS. 21 and 22 in which the upper portion of the blade takes the form of a round or "beaded" section 277*a*. Such a preferred blade construction has much greater transverse flexibility so it can be reeled or coiled and the like, which flexibility the T-blade shown in FIGS. 21 and 22 lacks.

FIG. 25 shows an end or cross section of the beaded blade 275*a* shown in FIG. 24 with a track or holder 281*a* which holds the blade 275*a* and through which it may be pulled or pushed longitudinally. The holder or track 281*a* may be conveniently formed of a plastic material such as polypropylene.

FIG. 26 is an end or cross section of a tear drop blade section 275*b* in a holder or track 281*b*. The teardrop blade, which it will be recognized is similar to the tapered blades shown in FIGS. 9 and 10, also has superior transverse flexibility and thus reliability and is, therefore, also a preferred construction, although not as preferred as the beaded construction shown in FIGS. 24 and 25. Both can be used when it is desired to reel or coil continuous wiper blades.

Figure 27:
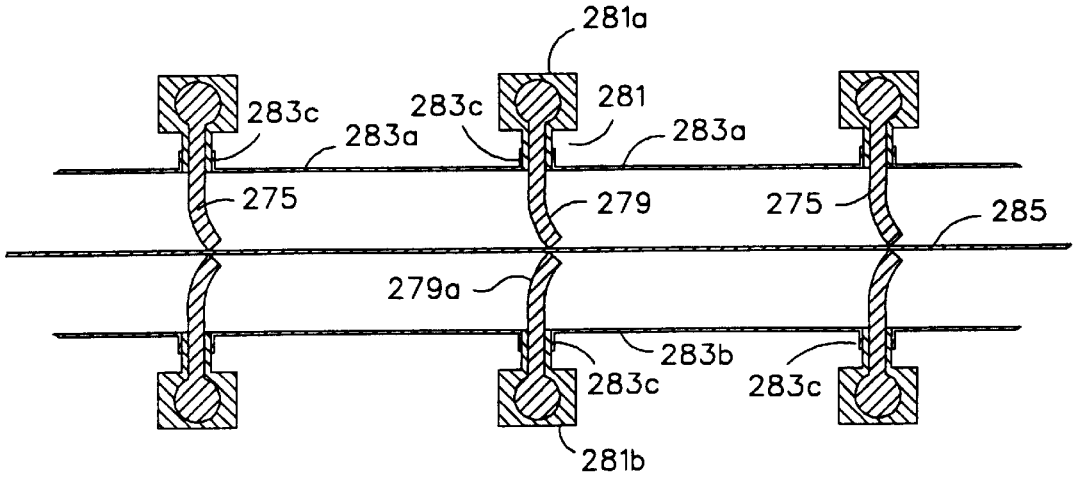
FIG. 27 is a broken away side view of beaded wiping blades and tracks as shown in FIGS. 28 and 29 in use wiping a strip surface.

FIG. 27 shows a series of beaded blade holders or tracks 281*a* mounted between flanged cathodes 283*a* and 283*b* at the top and the bottom of an anodic strip 285, respectively. It will be seen that the beaded blades 275*a* have been slipped into upper and lower beaded blade holders 281*a* and 281*b* from the side and such beaded blade holders 281*a* and 281*b* have been used as flange supports to which the flanges 283*c* of the upper and lower flanged anodes 283*a* and 283*b* have been attached by any suitable securing arrangement. Such attachment may be by any suitable securing means including mechanical securing which is effective to provide a permanent attachment of the flanges to the T-section supports. Welding or brazing might be used if the metallic track for the T-section shown in FIG. 23 is used, but a mechanical connection such as threaded fastening or even a clip arrangement will be more appropriate in use of the plastic tracks shown in FIGS. 25 and 26. It is not so important in this embodiment for the flanged cathodes to be disassembled to allow new wiping blades to be inserted between the flanged anodes as in the previously illustrated embodiments, since the blades can be inserted into the tracks from the side. Consequently, permanent attachment of the flanges of the cathodes can be made to the T-blade, beaded blade, tear-drop blade or other like potentially continuous blade support means.

Figure 28:
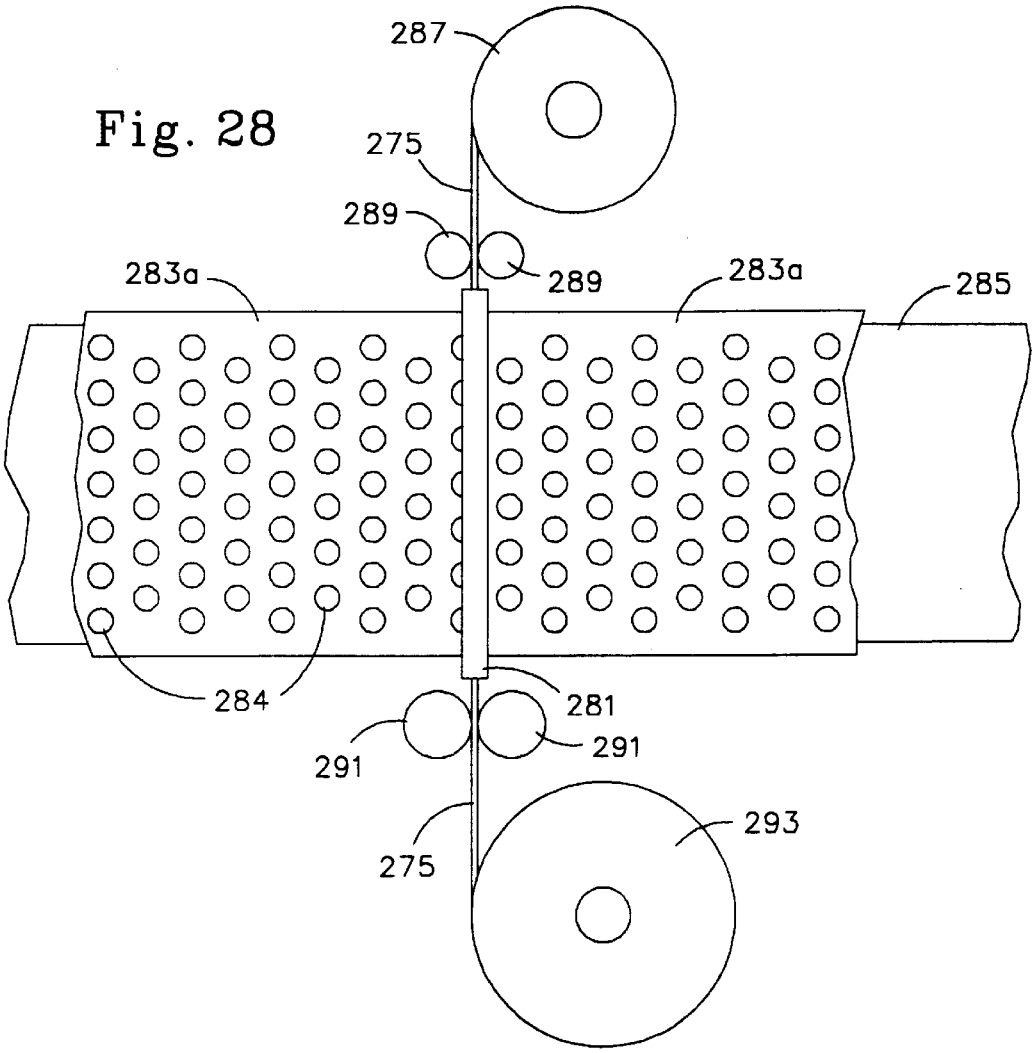
FIG. 28 is a partially sectioned diagrammatic top view of a beaded blade as shown in FIGS. 24, 25 and 32 mounted on a continuous coating line with reel-to-reel feed.

FIG. 28 is a top, partially broken-away view of the beaded section-type wiping blade 275*a*, designated here for convenience as 275, being fed at a controlled rate across the strip 285 in the holder 281 between adjoining perforated anodes 283*a*. It will be understood that similar perforated cathodes 283*b*, not shown, will be directly below the upper cathode 283*a*. The cathodes 283*a* and 283*b* have perforations 284, preferably staggered or overlapping perforations as in the other illustrations. The coil 287 of beaded wiping blade which is able to coil into a fairly tight roll or coil due to the small size or transverse dimensions of the beaded portion of said beaded blade is held in coil form on a reel and guided as it unwinds by the guide rolls 289, which are shown located at the entrance to the holder or track 281. The guide rolls 289 are positioned between the coil 287 and the beaded section guide or beaded blade holder 281*a* directly in line with the opening in the beaded blade holder so that as powered drive rolls 291 are turned, the beaded section is pulled into the end of the beaded blade holder 281 where it is held loosely so that it can be passed through the holder and out the other side between two guide-drive rolls 291 also in line with the end of the beaded blade holder 281. The drive rolls 291 feed the beaded blade 275 onto a take-up reel 293 which may itself also be powered.

The beaded blade holder 281 may be provided with resilient material, not shown, which may take the form of either a resilient plastic material or a series of spring-loaded guide plates, not shown, along the inside top of the beaded blade holder 281 which bear against the upper flange bead of the beaded blade such that the beaded blade is stabilized within the holder and bears against the strip 285 passing between the two perforated anodes 283*a* and 283*b*. As shown in FIGS. 24, 25 and 27, the lower portion or principal blade portion 279*a* of the beaded-blade 275*a* is preferably flexed as in previous embodiments of the wiping blade against the strip 285 to provide a very light wiping pressure against the strip and also to stabilize the position of the strip between blades as the strip 285 passes between the flexed portions 279*a* of the blades 275, if the strip is displaced either up or down, it will immediately place additional pressure against the flexible or resilient blade 279*a* causing such blade to flex more strongly and place a higher pressure against the side of the strip, thus tending to force the strip back into the central position between the two blades. In this way, the strip is very effectively stabilized between the blades, even though the blades do not press upon the strip with any great pressure and the blades do not interfere with the anodizing of the strip from the electrolyte adjacent the surface of the strip.

Figure 29:
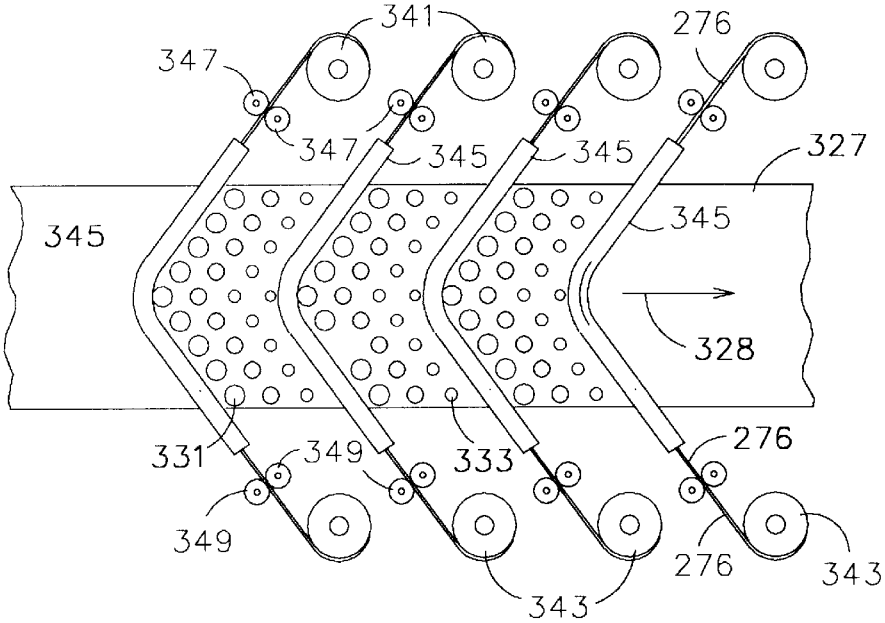
FIG. 29 is a diagrammatic plan view of an alternative arrangement of the embodiment of the invention shown in FIGS. 24, 25 and 28.

FIG. 29 shows the use of a beaded section-type wiper blade used against the strip surface of a strip 327 in a modified chevron arrangement. As explained above in connection with FIGS. 24, 25 and 27, the use of a beaded shaped wiper blade has certain advantages, the principal one being that it can be used in long lengths and moved progressively, either continuously or discontinuously, across the strip surface as the blade wears so that a fresh blade surface, or at least not a worn down or damaged blade, is presented to the metal substrate or strip surface at all times.

Figure 30:
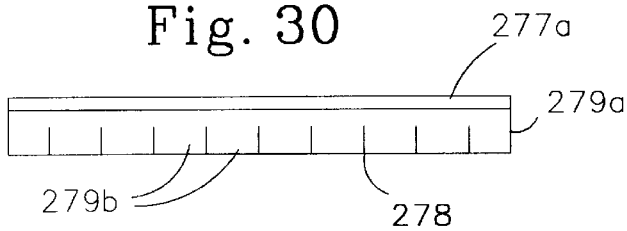
FIG. 30 is a side elevation of the modified beaded wiping blade used in the embodiment of FIG. 29.

The use of a chevron-shaped wiper blade, as disclosed in FIG. 30, is also advantageous as the construction not only does a very efficient job of directing both any debris detached from the surface of the strip to the sides, thus avoiding scratches, but also of sweeping out to the sides the heated electrolytic solution plus oxygen bubbles that are removed by the wiping blade from the surface of the strip while fresh cool or cooler electrolytic solution flows into the area between the strip and the cathode through perforations in the cathode. In the usual chevron wiper arrangement, the wiper blade sections in the two halves of the chevron are comprised of two separate blades even when the two blades as a unit extend entirely across the strip. This allows such blades to readily flex along their lower edges, which flexing is quite important to prevent the blades from wearing severely and also to provide the most effective wiping of the strip surface. If the wiping blade was, on the other hand, a solid bent blade, the shape of the blade would cause it to become essentially inflexible at its lower edge in the vicinity of the intersection of the two sections of the blade causing this section and adjoining sections to rapidly wear and interfering with the efficiency of wiping. In view of this relationship between continuous blades and a chevron configuration, it is not practical to have a continuously renewable blade such as shown in FIG. 28 with a strict chevron-shaped blade. However, the present inventors have developed a modified chevron configuration in which the center of the blade configuration is curved rather than intersecting at a definite angle. Such a curved configuration at the apex of the blade is shown in FIG. 29 described in further detail below.

Figure 31:
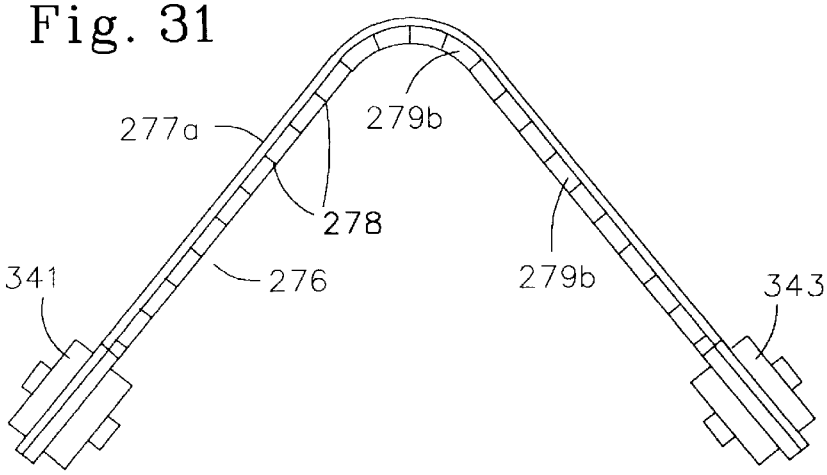
FIG. 31 is a diagrammatic oblique view of the modified version of the beaded blade shown in FIG. 30 arranged in the form it takes as shown in FIG. 29 with the blade mounted in the holders or tracks for such beaded blade-shaped section.

In addition to being arranged in curved configuration, the lower portion of the blade itself is slit at intervals as shown in FIG. 30. This allows the flexing portion of the blade to flex independently of adjoining portions of the blade. In FIG. 30 the upper crosspiece of the beaded section is designated as 277*a*, as before, and the lower wiping section is designated as 279*a*, while the separate elements between slits 278 in the blade are designated as 279*b*. Such slits enable the lower portion of the blade 279*a* to flex easily, even though the blade is bent transversely. Preferably, the slits in the lower blade 279*a* are indexed at predetermined distances so that when a new section of blade is moved into position, the portion extending over or under the strip has a slit more or less exactly in the center. This allows sufficient resilience or flexibility of the blade to prevent severe wear and to effectively wipe the surface of the strip. This is shown diagrammatically in FIG. 31 where a beaded blade 276 without the accompanying or guiding track or guide is shown with a beaded top 277*a* and the bottom flexible blade 279*a* with indexed slits 278 between discrete blade portions 279*b*. The blade 276 in the FIG. 31 is shown flexed rearwardly somewhat as it would be in actual use, but exaggerated, particularly in the center, to better show the slits 278 in the blade 276. This entire blade is shown bent or curved into the general triangular shape it would assume within a blade holder designated for retention between two flanges of adjacent perforated anodes, not shown. At the ends of the blade 276 are two capstans or reels 341 and 343, the first of which is a payoff reel and the second of which is a capstan for drawing the blade off the payoff real. This general arrangement is shown from above in FIG. 29 where a series of four payoff reels 341 are disposed next to four blade holders or guides 345 which extend across the strip similar to the blade holder 281 shown in FIGS. 27 and 28. Paired guide rolls 347 are disposed at the entrance to the holders or guides 345 to guide beaded section blades into the holders and the blades extend from the bottom of the holders 345 essentially as shown in FIG. 29 to bear against the strip surface. At the opposite ends of the blade holders or guides 345 are four capstans 343 again with paired guide rollers 349 between the capstan and the end of the blade holders 345. As the capstans 343 rotate, the flexible blades 276 are drawn onto the capstans 343. The orifices in the perforated anodes are larger immediately behind the blades and holders, i.e. in the curve provided, and smaller in front of the curve of each wiper blade to counteract possible cavitation behind the blades.

FIGS. 32, 33, and 34 show in three separate, but related figures, embodiments of the blade holders 345 in which FIG. 32 shows a beaded shape blade holder with a blade encompassed therein similar to the blade holder shown in FIG. 25 but with a somewhat different lower section on the blade holder 345 adapted for a somewhat different electrode and hanger system. FIG. 33 shows a cross section of a variation of a T-section blade which is more in the form of an L-section 355 with a short flange 357 on the top with the holder 359 for such section. The holder 359 has a conforming shape. FIG. 24 shows a cross section of a still further alternative embodiment of a blade section having the configuration essentially of a thin flat blade but formed from a series of short closely spaced or packed bristles 363 in a plastic holder 365. The holder 365 has a generally rectangular shape similar to that of holders 345 and 359. FIGS. 35 and 36 show respectively a side elevation and a bottom view of the wiping blade section 361 shown in FIG. 34. The upper portions 367 of the individual bristles 363 are bound together into a unitary structure that acts as a single wiping blade which can be in some cases drawn separately through the holder 365 as a unitary element. Since the series or collection of separate bristles 363 are intended to operate essentially together as a single or unitary wiping blade, it will be understood that they should be very closely packed or close together and arranged essentially in a close packed narrow row rather than dispersed and individually acting or abrading as in conventional brushes or, for example, in so-called brush plating.

FIG. 37 shows a cathode arrangement or assembly in which the embodiments of wiping blades shown in FIGS. 32 through 36 can be accommodated between unitary sectionalized sections of perforated cathode sections. In FIG. 37 hangers 367 support individual flanged perforated cathodes 369 having rectangular openings 371 between them into which the various plastic tracks 345, 359 or 365 of FIGS. 32, 33 or 34 fit to accommodate the flexible wiping blade structures.

The arrangements shown in FIGS. 24 through 27 and in FIGS. 32 through 36 are desirable, but relatively more costly designs in which the flexible wiping blades of the invention can be continuously or intermittently changed or renewed as the blade wears without stopping or interfering with the anodizing or other electroprocessing line operation merely by sliding the blade into and out of its track from the side. In arrangements such as shown in FIGS. 5*a* and 5*b*, 11 and 12, on the other hand, the basic hanger and electrode arrangement may make it relatively inconvenient to change the wiping blades of the invention or to rethread a new strip between the blades.

Figure 38A:
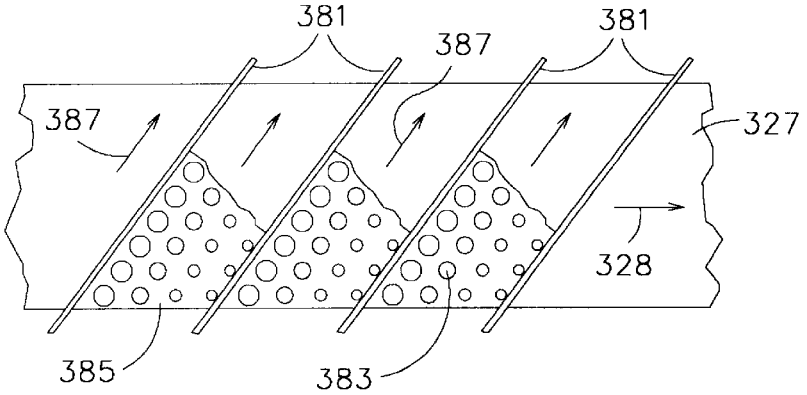
FIGS. 38A, 38B and 38C are diagrammatic plan views of alternative arrangements of straight wiping blade assemblies angularly extended across a moving strip.
Figure 38B:
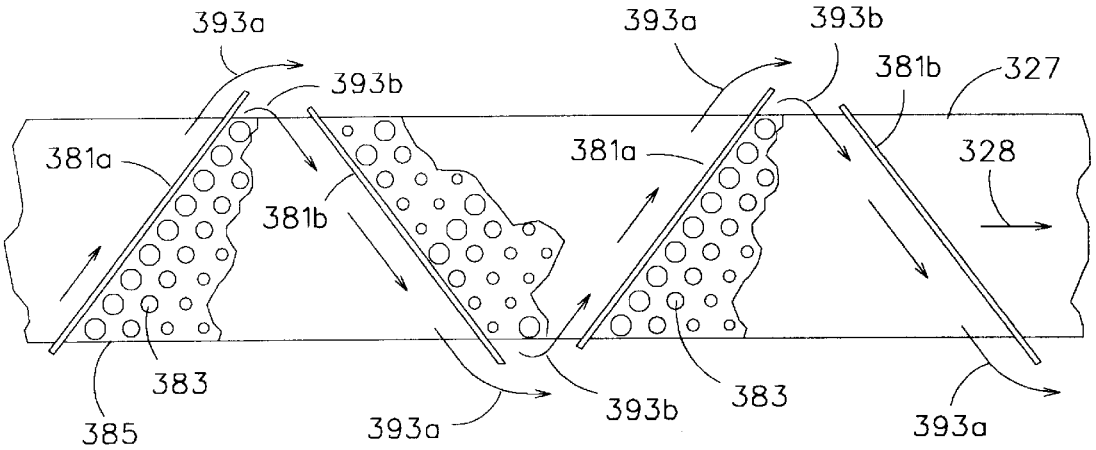
Figure 38C:
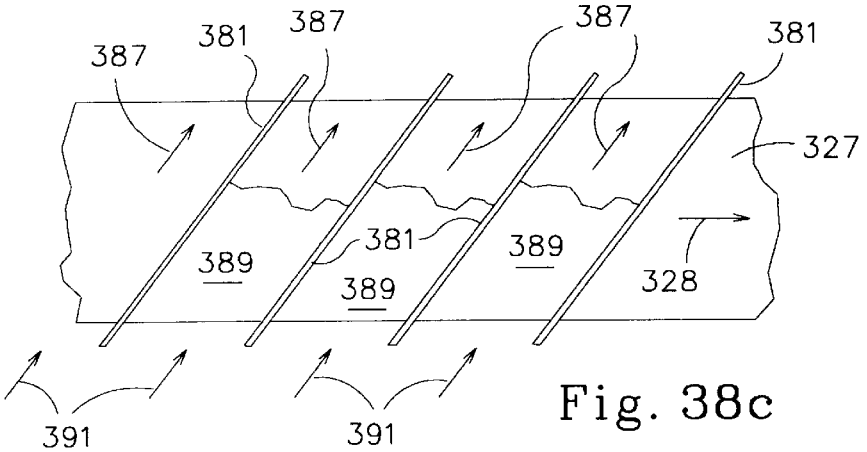

In FIGS. 38A, 38B, and 38C, there are illustrated still further arrangements of the resilient wiper blades of the invention in which the blades, instead of being positioned at right angles with respect to the movement of the strip, are instead extended at an angle across the strip or anodic workpiece. Such arrangement has the advantage of encouraging a liquid electrolyte or fluid current to flow across the strip or anodic workpiece, which fluid or liquid current can be made to flow in any direction depending upon the angle across the strip assumed by the wiping blade. The arrangement is thus similar to the chevron-type wipers shown in previous figures, except the flow created is directed to one side only rather than toward both sides of the strip. Liquid flow toward only one side has several significant advantages over splitting the fluid flow and directing such flow toward both sides of the strip as shown in previous figures. Having a more or less uniformly angled blade extending across the strip has the significant advantage, first, of creating a stronger fluid current or flow overall, which increased fluid flow more vigorously removes the electrolytic solution from in front of the wiping blades and sweeps it to the side. Secondly, the advantage of an angled blade is also attained without the principal disadvantage of a chevron-type blade arrangement, which may require a split in the center of the blade to allow the requisite flexibility or resilience of said blade.

In FIGS. 38A, 38B, and 38C, three possible arrangements of substantially straight, but angled, wiping blades are shown. In the first of these shown in FIG. 38A, a series of resilient wiper blades 381 are shown diagrammatically angled across the strip 327 which moves in the direction indicated by the arrow 328. A series of perforations 383 are provided in perforated cathodes 385 which bridge the area between the wiping blades. Such perforated cathodes are shown partially broken away to reveal the underlying surface of the strip 327 as well as arrows 387 which indicate the fluid current established in the electrolytic fluid between the perforated cathodes 385 and the surface of the strip 327. In fact, with the vigorous fluid current established along the face of the strip by the angled blades, perforations in the cathode may not even be necessary, as shown in FIG. 38C where, the same series of angled resilient wiping blades 381 are shown, but have associated with them a series of unperforated cathodes 389.

The anodes 389 in FIG. 38C are also partially broken away in their top portions to reveal arrows 387 which indicate the direction of flow of liquid current established between the surface of the cathode and the surface of the moving strip, between which surfaces the electrolytic solution flows toward the section of the strip shown at the top. The flow of the liquid current is all in one direction, as shown at the top of the figure by the arrows 387 where the cathodes 389 have, as indicated, been partially broken away. Likewise, the flow into the space between the cathodes 389 and the surface of the strip is completely from one side, as shown by arrows 391. Such flow from the side is usually sufficient to completely flush away heated electrolytic solution which is physically forced away from the strip surface by the resilient wiper blades and is immediately caught up and mixed with the flow of electrolytic solution flowing through the space between the cathode and strip surfaces and thoroughly flushed from between the strip surface and the electrode by the fluid current induced. Such heated solution is then replaced by fresh solution flowing in from the opposite side of the strip.

FIG. 38B shows an alternative arrangement of slanted or angled wiper blades in which alternate blades are angled in opposite directions, or at opposite angles. In this arrangement, the liquid flow is first across the moving strip from one side and then across the strip from the other side. This arrangement provides a more even mixing in the bath on both sides, but has the drawback of inducing a flow into the small end of the space between two angled wiper blades and out of the larger end resulting in a definite tendency to have a progressively lessening flow across the strip, somewhat counterbalanced by the use of perforations in the cathodes. In FIG. 38B, there are shown a series of four angled wiper blades 381*a* and 381*b*, the blades 381*a* being inclined downstream of the moving strip to the left as viewed from above and the blades 381*b* being inclined downstream to the right. Both sets of blades 381*a* and 381*b* have their trailing ends extended farther to the side of the strip than the leading ends of the adjacent blades. This serves to at least partially direct the current of electrolyte solution about the longer trailing end of the resilient wiper blades in a transversely displaced path such that it more or less completely bypasses the adjacent leading end of the next adjacent wiper blade as shown by the arrows 393*a*. The flow along the adjacent wiper blade therefore tends to be derived from above and below the strip, as shown by the rear curved portion of the arrows 393*b*. Perforated anodes 385 in FIG. 38B allow additional electrolytic solution to be drawn in through orifices 383 in the cathodes from the top and bottom areas of the bath next to the strip to compensate for the gradually increasing size of the opening between the wiper blades and to secure a more constant flow across the strip surface which aids in flushing away the heated electrolytic solution physically scraped or diverted by the wiping blades 381*a* and 381*b* from the excessively heated layer next to the strip and normally carried along with the strip surface.

Figure 39:
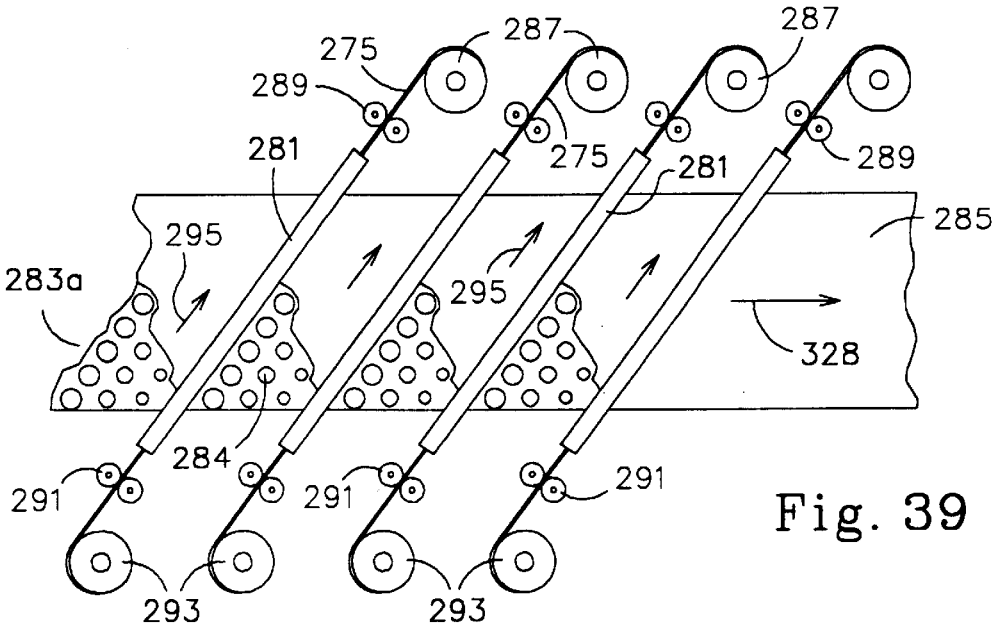
FIG. 39 is a diagrammatic plan view of an assembly of replenishable beaded-blade-type wiping blades extending angularly across a moving strip.

In FIG. 39 there are shown a series of slanted or angled replaceable wiper blades such as shown in FIGS. 25 and 26 the difference from the previous figures being that the tear-drop, or beaded blade is drawn across the strip surface at an acute angle, as shown in FIG. 39, rather than at a right angle to the strip, as shown, for example, in FIG. 26. This has the advantage over the arrangement shown in FIGS. 28 and particularly 29 that the continuous wiping blade does not need to be slit to maintain its flexibility or resilience in the vicinity of the intersection of the chevron-shaped blade or in the arcuate section of a generally chevron shaped blade having a curved apex, thus eliminating any leakage through the slits, or discontinuities, in the blades which might act as "traps" for debris, thus causing scratches or other defects on the finished surfaces of the anodized strip. The slanted blade, on the other hand maintains a snowplow-like action on the surface of the strip. Such snowplow-like action aids in establishing a transverse movement of electrolytic solution across the strip, thus flushing away excessively heated electrolytic solution removed from adjacent the surface of the moving strip by the action of the resilient wiping blade. The various parts shown in FIG. 39 use the same reference numerals as in FIG. 28 in which the continuous resilient wiper blade 275 passes from a reel 287, between a pair of guide rolls 289 and into a blade holder or retainer guide 281 mounted preferably between perforated top anodes 283*a* and bottom anodes 283*b*, not shown, anodes 283*a* being partially broken away to reveal arrows 295 indicating the general flow of electrolytic solution between perforated anode 283*a* and the surface of the strip 285. Each of the anodes 283*a* and 283*b* are provided with perforation or orifices 284, which are shown as differentially sized orifices such as previously disclosed. Such differentially sized perforations may be advantageous because the movement of the strip tends to urge the electrolytic solution more toward the downstream wiper blade. However, more or less uniform sized orifices can also be used. From the holder or retainer guide 281, the continuous flexible blade 275 passes between two further guide rolls 291 and then onto a reel 293.

While the angle of the wiper blades 275, for convenience, are shown in FIG. 39, as well as in FIGS. 38A, 38B, 38C and 40, as being approximately 45 degrees with respect to the strip in the direction of movement of the strip, the greater the angle, the faster the flow induced across the strip. An angle of approximately 45 degrees will usually be found very satisfactory to obtain an effective flow. The actual preferred angle is that angle which will result in sufficient flow to quickly flush out or away from the vicinity of the wiping blades all excessively heated electrolyte and oxygen bubbles which might otherwise tend to slow down anodizing action. It may be undesirable to have too acute an angle between the strip and the wiping blade because the heated electrolytic solution, although rapidly diluted with cooler flowing electrolytic solution, is maintained longer on or between the strip and electrode surfaces. However, a fairly steep angle of the blade with the strip is usually desirable.

Figure 40:
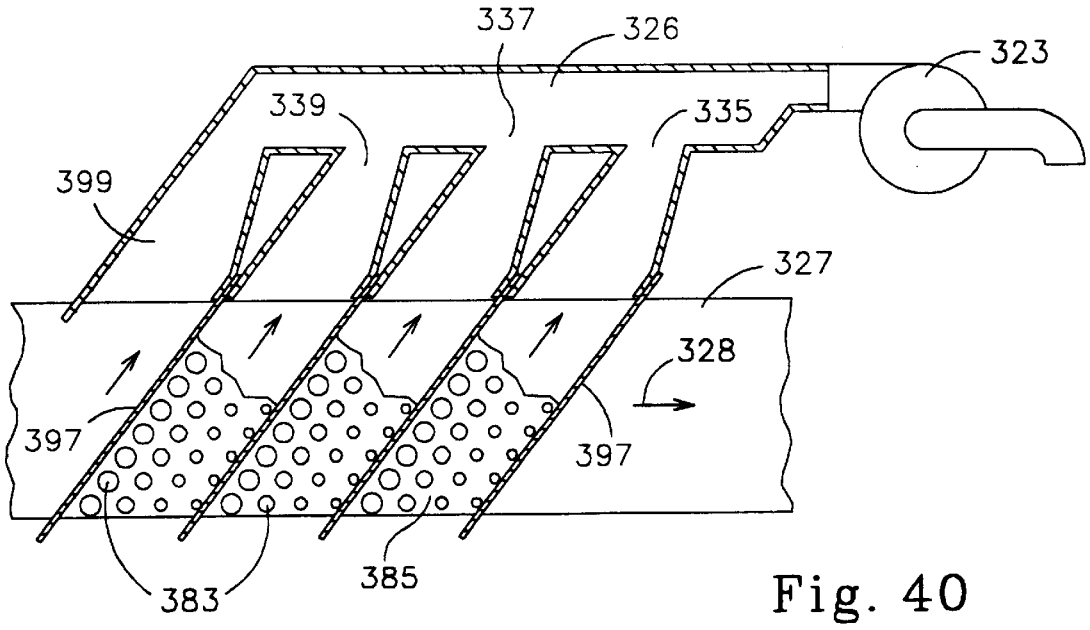
FIG. 40 is a diagrammatic plan view of an arrangement of angled wiping blades extending across a moving strip with a solution exhaust pump arrangement on the downstream side to accelerate removal of spent electrolyte.

FIG. 40 shows a still further embodiment of angled resilient wiper blades in which the flow of the electrolytic solution in one direction toward one side of the strip is taken advantage of by using a forced solution removal pumping arrangement. In FIG. 40 the straight angled wiper blades are indicated by reference numerals 397, while the partially broken-away perforated anodes 385 allow additional flow of electrolytic solution from the top and bottom. As in FIG. 38C, the cathodes could, if desired, be unperforated, since the flow of electrolytic solution will be established from the side and will be continuously maintained by the combination of the angle and the movement of the strip transverse to said angle tending to move the solution to the side. This results from the induced component of motion of the electrolyte to the side as its continued movement along with the strip is blocked by the dam interposed by the wiping blade. Because of the rapid induced flow to the side, the electrolytic solution is completely changed in a very short period, maintaining fresh solution next to the strip surface and rapidly flushing away excessively heated solution and oxygen bubbles diverted by the wiping blade from adjacent to the surface of the strip very rapidly. At one side of the strip is a pump 323, preferably a centrifugal pump having an inlet leading to a main manifold 326 with a plurality of separate individual manifolds 335, 337 and 339 connected with one side of the spaces between the wiping blades. In addition, there is shown in FIG. 40 an improvement comprising an additional separate manifold 399 arranged in front of the series of blades 397, which separate manifold 399 also aids in drawing away electrolytic solution which is deflected to the side of the initial slanted or angled resilient wiping blades 397, thus aiding in directing said electrolytic solution to the side and out into the body of the coating bath, rather than over the tops of the perforated cathodes where it might be drawn in again to the surface of the strip before being thoroughly mixed and cooled by the fresh bath solution.

FIG. 41 is a diagrammatic isometric view of an alternative less preferred form of wiping blade 301, referred to generally as a honeycomb-type wiping blade. Such honeycomb-type wiping blade 301, as shown, comprises a series of plastic hexagonal membranes which form a series of interlocking walls or blades having generalized outer and inner ends 303 and 305. Such two ends or sides may be referred to as outside and inside. Conventionally, the inside will be considered to be the wiping side and the outside to be the external side away from the strip. The openings through the honeycombs are designated as 304 and serve as passageways for oxygen bubbles and heated electrolyte to pass through the honeycomb.

An assembly of honeycomb-type wiping blades 301 are shown mounted adjacent alternating upward and downward runs or legs 309 of the strip 307 in FIGS. 42 and 43. FIG. 42 is an enlarged section taken along line 42—42 in FIG. 43, but additionally showing the guide rolls at the end of the leg of the strip. FIG. 42 is somewhat distorted in that it is foreshortened so the guide rolls have been moved toward the center and appear to overlap the honeycomb wiper itself. The upward and downward legs of the strip 307 are maintained in place by a series of upper guide rolls 311 and lower guide rolls 313. These guide rolls 311 and 313 effectively direct or turn the strip 307 within an anodizing tank, not shown, into more or less vertical runs which are shown slightly slanted in FIG. 43, which as indicated is a diagrammatic illustration of the same overall coating line assembly, but, it will be understood, could be completely vertical in orientation and arranged such that the honeycomb wiping blades 301 when placed against the sides of the strips are oriented in such a position that when bubbles of oxygen are wiped from the surface of the strip, such bubbles and excessively heated electrolyte can pass through the openings 304 and the honeycomb structure as a whole and escape into the coating bath where they float upwardly to the surface of the bath, not shown. In the embodiment of the invention shown in FIGS. 42 and 43, each of the honeycomb sections 301 are in fixed position, close to the sides of the strip and as the strip passes upwardly, it will tend, by shifting from side to side, to contact first one section of the honeycomb on one side and then another section of the other honeycomb on the other side. In this manner, the strip is continuously being wiped in some sector of the strip against one of the honeycombs and in most cases will be continuously wiped at several sectors between each honeycomb as it deviates from side to side. While this arrangement is not as satisfactory as having actually flexed blades continuously biased or resiliently forced against the side of the strip at all times, it does serve to prevent the strip from touching the electrodes 315 which are positioned outboard of each of the honeycomb sections 301. In this way, arcing between the strip and the anodes is prevented and the surface of the strip is continuously wiped to remove bubbles of oxygen and excessively heated electrolyte. A fairly effective continuous wiping of the surface of the strip is thereby effected. In FIG. 42, the outer of two honeycomb wipers 301 is shown with the strip 307 passing under such honeycomb wiper and the outer perforated anode removed or not visible. It should be understood that a further honeycomb wiper not shown is under the strip 307. In other words, the view in FIG. 42 is, as indicated above, of the assembly taken along section 42—42 in FIG. 43 described hereinafter.

FIG. 42 shows the honeycomb section 301 in a partially broken-away side view of one of the legs or runs of the strip 307 about the guide rolls 311 and 313. It will be seen with reference to FIGS. 42 and 43 that the honeycomb section extends completely across the surface of the strip 307 and on a statistical basis, continuously wipes the strip in the various consecutive sectors of each run or up and down leg so that after the strip gets through a series of runs, it has been rather thoroughly wiped at various places as it passes between the honeycomb sections.

FIG. 44 is a further side illustration of an embodiment of the invention in which honeycomb sections 301 are provided along the vertical or angled runs of a strip 307 being passed over the upper guide rolls 311 and lower guide rolls 313 as in FIG. 43. In FIG. 44, however, the honeycomb sections are resiliently mounted against the bottom of perforated anode sections 315 by resilient means 317 which may take the form of a resilient plastic construction or in some cases, polymeric spring-type structures which are resistant to the electrolytic coating bath. The arrangement shown in FIG. 44 will be recognized to provide a more positive wiping action of the honeycomb sections upon the surface of the strip 307, but also to provide a more complicated arrangement having in addition, increased likelihood of actual failure of the resilient means to keep the honeycomb sections positioned against the strip surface. However, it will be recognized that even if the resilient means should fail, the honeycomb sections are still held in position essentially in the same positioning as shown in FIG. 43 where such honeycomb sections are in permanent placement adjacent to the strip. Consequently, even if the resilient means 317 in FIG. 44 should fail, the arrangement will still remain operative.

It will be recognized that the honeycomb arrangement for wiping blades with its possible wiping action, may be offset by the detriment of greater wear, if the honeycomb sections are actually forced against the side of the strip surface. However, because such strip surface tends to have a greater wearing effect upon the relatively solid structure of the honeycomb sections, rather than dissipating the force by the actual resiliency of a flexed blade or a thin flexed blade as shown in previous figures, there may be limited disadvantages in the arrangement shown in FIG. 44. However, to some extent the multiple walls of the honeycomb construction provides more polymeric material to wear so that the life of such wiper may not be actually that much diminished from the wear which is experienced by flexed blades.

FIGS. 45 and 46 are a top view and a cross section through a somewhat different form of flexible plastic wiping strip related to the honeycomb-type wipers shown in FIGS. 41 through 44. In FIGS. 45 and 46, a flexible plastic mesh 401 of transversely flattened members 403 and 404 arranged in an intersecting grid arrangement and having a mesh or membrane thickness typically of about ⅛ to ¼ inches is used as a wiper. The plastic mesh member may be either held against the surface of the strip being anodized as it passes the plastic mesh membrane in a manner similar to the manner in which the honeycomb wipers of FIGS. 41 through 43 are held against the strip or may be preferably continuously drawn across the strip to be coated from one side to the other to wipe the strip, removing oxygen bubbles, wiping or sweeping away any excessively heated layer of electrolyte on the strip and also preventing the strip from touching the adjacent electrodes and arcing. The mesh membrane may have relatively flat interconnecting members as shown in FIGS. 45 and 46, for example, substantially flat longitudinal mesh sections 404 intersect at right angles with vertical, or transverse, mesh members or sections 403 as seen in FIG. 46. However, the mesh sections could also less desirably be rounded or arcuate in cross section.

The advantage of the relatively thin plastic mesh shown in FIGS. 45 and 46 is that it can be bent, allowing it to be held upon or reeled upon a reel or the like. FIG. 47 shows such an arrangement in which pairs of power-driven upper reels 405 and 407 and lower reels 409 and 411, respectively, unreel and reel thin, flexible mesh or grid-type wiper material in the form of strips or belts 413 and 415 which pass between the two reels 405 and 407 and 409 and 411 between a moving anodic workpiece 417 and adjacent upper and lower perforated cathodes 419 and 421, see in particular FIG. 48 which is a cross section of FIG. 47 along section line 48—48 with the mesh-type belts 413 and 415 closely spaced and preferably touching the strip 417 as it passes across the strip surface from side to side.

For convenience in illustration, the payoff reel or roll 409 and take-up reel or roll 411 of mesh-type wiper material is shown at the bottom of the view rather than being shown directly below the payoff reel or roll 405 and take-up reel or roll 407 where it would normally be situated so the reels or rolls would be outside the anodizing tank, not shown, the level of electrolyte in the tank being at all times over the cathode 419.

It will be seen in FIG. 48 that the plastic mesh belts 413 and 415, while closely adjacent to the surface of the cathodic strip, are spaced from the perforated cathodes 419 and 421. Such arrangement is necessary, as is the space between the strip and the cathode in FIG. 48, to prevent uneven camber anodic strip from becoming, so to speak, stuck between the belts if they were touching the surface of the cathodes which are relatively immovable. Even large burrs on the edge of the strip or wavy strip edges might tend to jam the strip between the cathodes. While the flexing blades shown in previous figures, for example, in FIGS. 11, 13, and 17 to 19 and the like, all by their normal flexure can relieve force exerted by out-of-camber strip passing between the blades, if the mesh-type wipers shown in FIGS. 45 through 51 were entered into a close tolerance space between immovable anodes and a variation in the effective strip thickness caused by camber or the like or torn edges on the strip occurred, such variation in effective thickness could readily jam the strip between the mesh-type wipers and the cathodes causing tearing, or worse, of the mesh and quite likely also damage to the strip itself. Consequently, in FIGS. 47 and 48, the mesh material 413 and 415 is shown held against the strip 417, but not against the cathodes 419 and 421. While the movement of the mesh material is thus not as effective to strip away or remove heated electrolyte from between the cathodes and the strip, a fairly effective removal of heated electrolyte and replacement with fresh cooler electrolyte brought in from the side takes place.

FIGS. 49, 50 and 51 are plan views of additional patterns of mesh-type wiping materials that may be drawn across the strip in the same manner as shown in FIGS. 46 and 47 to remove oxygen bubbles, strip away excessively heated electrolyte from the surface of the strip and prevent too close approach of the anodic workpiece to the cathodes, thus preventing arcing between the anodic workpiece and the cathodes. The thickness of about one eighth to one quarter inch of the mesh material plus its dielectric composition is sufficient to prevent arcing due to too close approach of the strip and electrodes.

Figure 52:
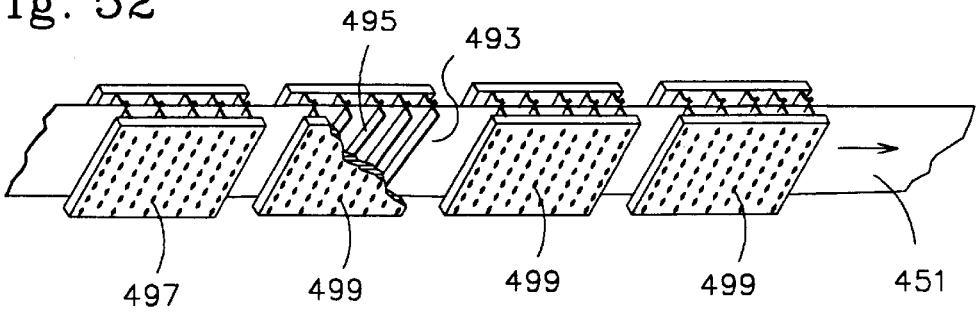
FIG. 52 is an isometric view of a strip oriented vertically in an anodizing operation using the flexible wiping blades of the invention.

It is not unusual in the anodizing of metal substrates to run a strip or sheet of aluminum or other light metal, or light metal coated base metal, through the bath on one edge, or vertically oriented, instead of horizontally oriented. Such disposition allows the troublesome oxygen bubbles to be displaced from both surfaces by their own buoyancy, particularly on what might otherwise be the underside of the sheet or strip where the buildup of bubbles of oxygen is particularly troublesome. The strip can, of course, also be run consecutively over guide rolls into a series of vertical loops having vertical runs between them. This is effective to eliminate large bubbles, but is relatively ineffective against small oxygen bubbles that can cling to the sheet or strip by normal adhesion or capillary attraction and in the case of vertical loops or runs of strip, the guide rolls occlude significant amounts of strip surface. In addition, while the vertical orientation of the strip also tends to encourage the migration upwardly of an excessively heated electrolytic layer next to the strip, such tendency to rise is relatively minor. Consequently, the use of the present invention in the form of flexible plastic wiping blades is very beneficial for use with vertically oriented strip as well as horizontally oriented strip. Such use is shown in FIG. 52 where a vertically oriented strip 451 positioned in an electrolytic anodizing bath, not shown, on one edge is provided with a series of flexible plastic wiping blades 493 also disposed with a vertical orientation preferably somewhat slanted so the movement of the electrolyte is encouraged to be upwardly. In other words, the lower portion of wiping blade will be somewhat advanced on the sheet surface counter to the movement of the strip encouraging the buoyancy of detached bubbles and heated electrolytic solution to aid the wiping blade in moving such bubbles and solution upwardly. Thus, in FIG. 52, the strip 451 passes an upwardly slanted wiper blade 493 which wipes the oxygen bubbles and hot solution in a generally upwardly direction from the surface of the strip as shown by arrows 495, some of the solution and bubbles passing through the orifices 497 in cathodes 499. This wiping action strips the surface of the sheet being anodized periodically of both oxygen bubbles and also excessively heated surface electrolyte as well as serving through the resiliency of the wipers to stabilize the position of the strip between the wiping blades, allowing the cathodes to be more closely spaced to the anodic strip and allowing a greater current or current density to be attained with lower total power.

While the collection of bubbles of oxygen at the anodic surface is the principal difficulty with gas bubbles in anodizing, the hydrogen bubbles that gather upon the cathode also tend to insulate the cathode from the electrolyte, thus interfering with the achievement of high current densities at economical power factors. Consequently, it will be beneficial in some cases to wipe the cathode surface as well as the anodic strip surface. This can be conveniently done in an anodizing operation by passing a series of thin loops of the geometric plastic mesh shown in FIGS. 45 and 46, 49, 50 or 51 past the surfaces of both the anodic strip and the cathodic electrodes. In such case, since it is desired to contact both the surface of the strip and the surface of the cathode at the same time, usually with opposite sides of the plastic mesh, an arrangement for allowing the electrodes or cathodes to move outwardly to relive pressure against the strip, if an out-of-camber strip or strip with uneven edges passes between opposed moving geometrical mesh, is necessary. Such relief can be attained with an arrangement somewhat as shown in FIG. 44 where the cathodes are mounted on resilient means such as springs or the like to keep the honeycomb wiper section always resiliently against the strip surface.

Figure 53:
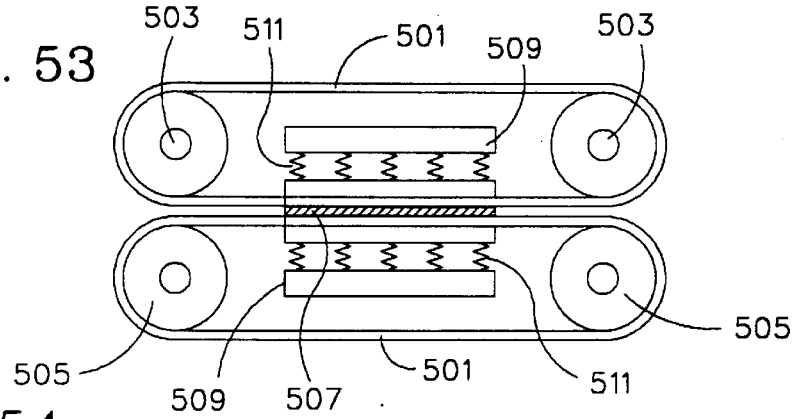
FIG. 53 is a transverse section of an anodizing line incorporating an endless mesh-type belt embodiment of the invention.

In FIG. 53, a pair of continuous belts 501 of plastic mesh such as shown in FIGS. 45, 46, 49, 50 or 51 are passed about two pairs of guide rolls 503 and 505 with one reach of each continuous loop passing between the surface of the anodic strip 507 and the cathodes 509 on both sides as shown. The cathodes 509 are biased toward the belt 501 by resilient spring means 511 bearing against any suitable support which spring means not only keep the cathodes against the strip, but also allow the cathodes to move away from the strip 507 and the belt 501 if the effective transverse dimensions or thickness of the strip varies so the strip is continuously subjected to a light contact pressure only sufficient to keep the wiping elements, i.e. the mesh pattern belt 501, against the strip.

A further possibility would be to provide extensions of the grid pattern in a transverse direction to form thin resilient extensions in the form of transverse blades on both sides of the mesh belts which flexibly contact the surface of both the strip on one side and the cathode surface on the other. The belt may have an outer section on both sides lacking the thin flexible blades and around which the belt is journalled on suitable rotatable support rolls or the like to maintain rotatability of the mesh belt without bearing upon the thin flexible wiping sections extending from both sides of the belt. The belt is continuously rotated in these arrangements to continuously wipe the surface of both the anodic strip and the nearby cathodic surface. A belt arrangement having thin wiping blades extending from both surfaces is shown in FIG. 54 in which the reference numeral 521 designates a continuous flexible geometric mesh belt having flexible blade portions 523 on the outside and 525 on the inside journalled about rotatable guide wheels or rolls 527 on both sides so the flexible blades are continuously moved transversely across and against both the anodic strip 507 and the cathodes 509.

Figure 54:
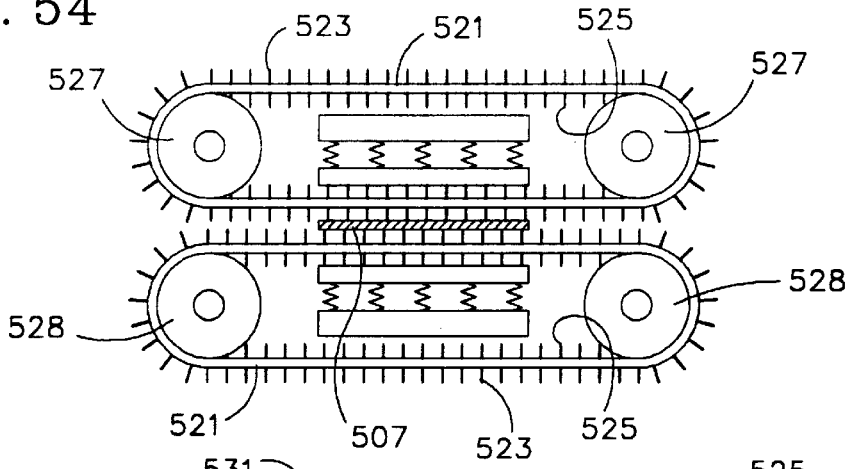
FIG. 54 is a transverse section of an anodizing line using an endless mesh-type belt embodiment of the invention having flexible wiping extensions transversely across the belt.
Figure 55:
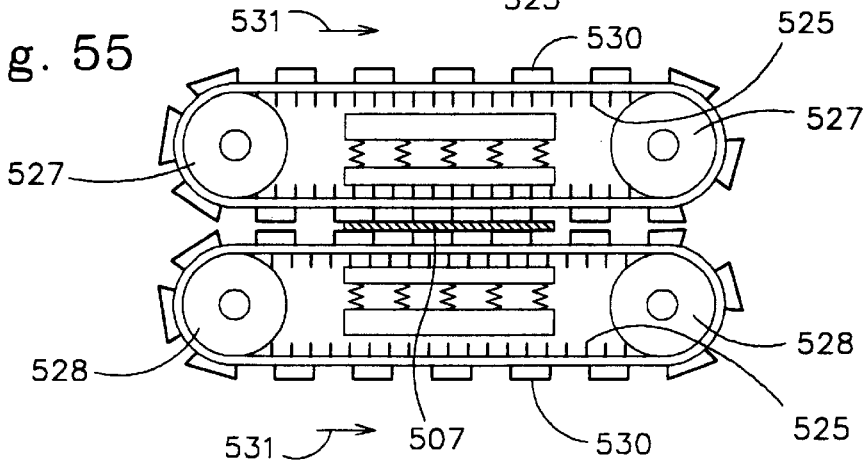
FIG. 55 is a transverse section of an anodizing line using an endless mesh-type belt embodiment of the invention having flexible wiping extensions transversely across the belt as in FIG. 54, but in which the flexible wiping extensions or blades on the exterior of the belt are disposed at an angle with respect to the belt as well as the strip or web.
Figure 56:
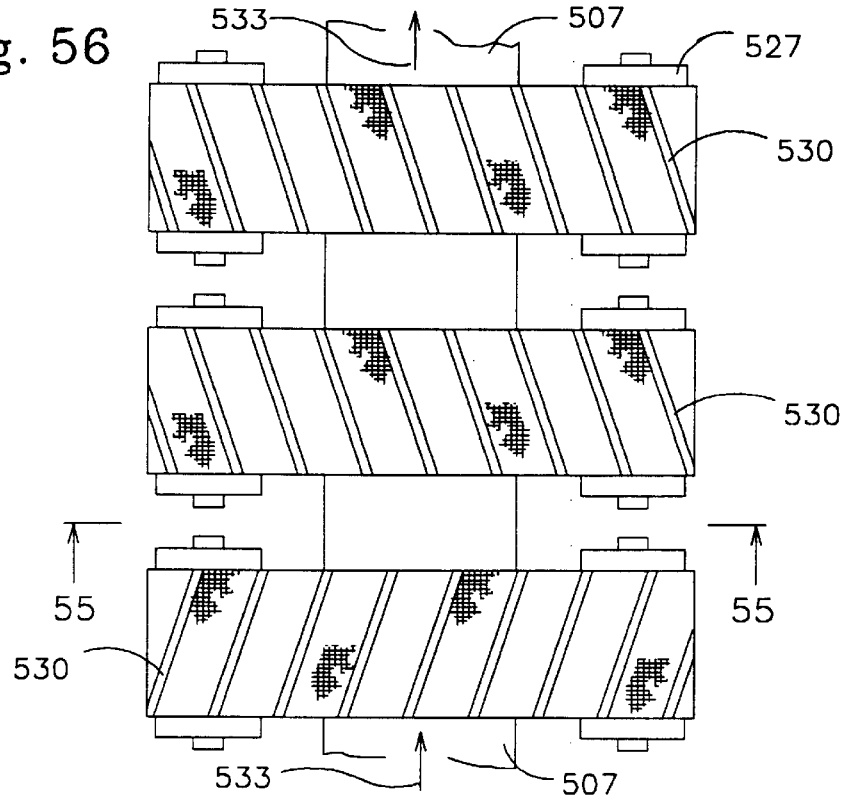
FIG. 56 is a plan or top view of the transverse section shown in FIG. 55.

In FIG. 54, because the thin flexible blades 523 and 525 extending from the mesh-type belt 521 are positioned transverse to the mesh belt, when such belt is drawn across the surface of the strip, bubbles and excessively heated electrolyte are wiped from the anodic strip surface toward one side of the strip. This provides a thorough wiping of the strip as it passes the mesh-type belt, the openings in which allow free passage of bubbles of both oxygen and hydrogen, plus electrolyte. Since the blades bearing against the strip surface in FIG. 54 are, however, disposed lengthwise of the strip, the movement of the strip itself along the processing line has little effect upon the removal of bubbles of oxygen and excessively heated electrolyte from the strip surface, although the movement of the strip along the length of the blades does induce some additional turbulence that has some beneficial effect upon the bubble situation and the temperature of the electrolyte next to the strip surface. However, any such effect is not great. On the other hand, if the thin flexible blades on the outside of the flexible mesh belt are angled, the movement of the strip past the continuous belt may be taken advantage of to wipe the surface of the strip as well. Such an arrangement is shown in FIGS. 55 and 56 wherein it may be seen that the outside wiper blades 530 are angled so that movement of the strip against the blade will, as in other embodiments of the invention, wipe the surface of the strip against the blade, sweeping the electrolyte and bubbles from the surface. At the same time, the transverse movement of the flexible belt upon which the blades are angled also in itself sweeps electrolyte and bubbles from the surface. Preferably the direction of rotation of the continuous belt is such that the movement of the strip and the movement of the belt complement each other and increase the velocity at which the electrolyte is moved toward the edge of the belt. Thus, the electrolyte should be urged from the side of the belt facing in the direction of movement of the web or strip. With this direction of movement, the electrolyte first strikes the back of the blades due to the strip motion, which is usually faster than the motion of the belt in a high speed line and is propelled toward and off the side of the strip at an angle in the same general direction as the motion of the strip as well as through the orifices in the mesh of the belt. At the same time, the movement of the blades along with the belt picks up the electrolyte on the front of the blade and propels it at an angle in the same general direction as the movement of the strip but toward the side. If the belt moves in the opposite direction, however, the movement of the belt will tend to propel the electrolyte counter to the movement induced by the movement of the strip with a general decrease in overall velocity of the electrolyte off the edge of the strip. However, in some cases, adjacent belts may have their blades inclined in opposite directions to increase the turbulence and mixing between the belts. Such an arrangement is shown between the two belts at the bottom in FIG. 56, which shows a top or plan view of the embodiment of FIG. 55 showing wiping blades 530 upon the upper two belts 501 angled in one direction which will add to the velocity at which the electrolyte is propelled at an angle off the belt in the direction of movement of the strip and the angle of the blades on the lower belt angled so the movement of the belt counteracts the movement of the strip causing additional turbulence.

It will be understood that the blades could also be arranged longitudinally of the strip so that the blades are exactly transverse of the strip and completely block longitudinal motion of the electrolyte with the strip. However, because the blades must bend around the curvature of the belt as the belt passes at the ends around the supporting rolls 527 and 528, stress is placed on such blades unless they are pre-split to go around the radius over the support rolls, which splits may not completely close upon straightening out the belt again. Discontinuous staggered transverse blades may also be used, but have the disadvantage of not as quickly flushing the electrolyte to the side, although again, increased turbulence is attained, which, in itself, is advantageous. In FIG. 55, the angled blades 530 can be seen from the side, while FIG. 56 shows a plan view of the same arrangement having three separate, but connected, continuous mesh-type belts. FIG. 55, which is comparable to FIGS. 53 and 54, is a cross section along section line 55 in FIG. 56. The cathodes 509 visible in FIGS. 53 through 55 are not visible in FIG. 56 because such cathodes are under the belts 501.

Figure 58:
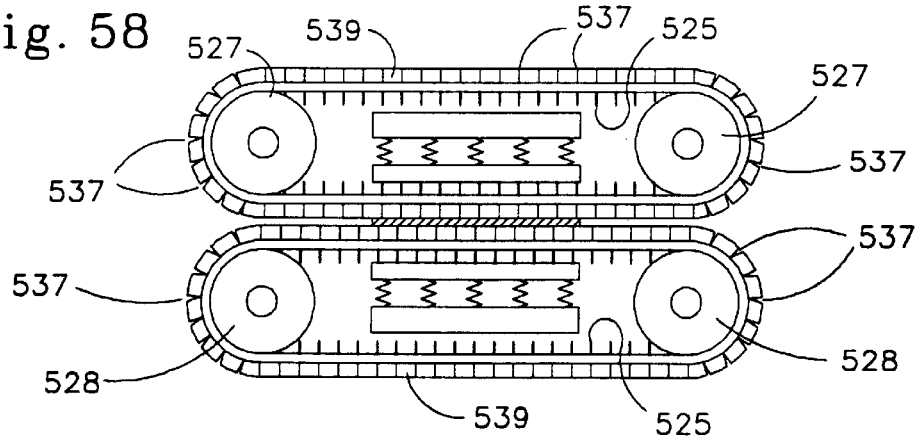
FIG. 58 is a transverse section of the arrangement shown in FIG. 57.
Figure 57:
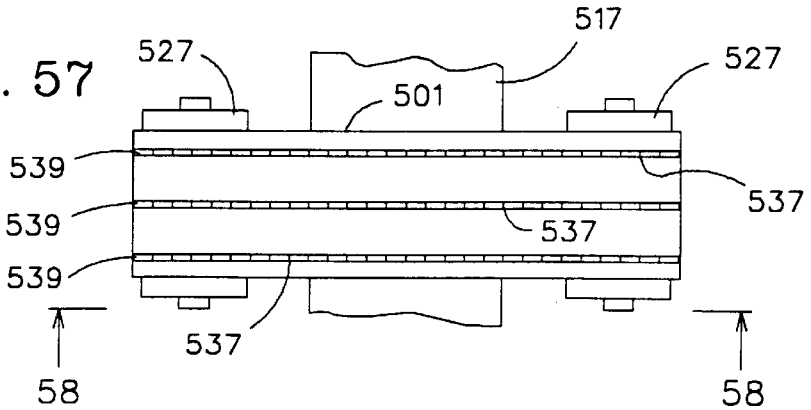
FIG. 57 is a top or plan view of an alternative embodiment of the invention in which the blades on the exterior of the endless mesh-type belt are positioned longitudinally of the mesh-type belt and transversely of the strip or web constituting the workpiece.

FIG. 57 is a further plan view and FIG. 58 is a cross section of an embodiment of the invention having straight transverse slitted blades on the outside of the rotating belt to continuously oppose passage of an excessively heated surface layer of electrolyte along the surface of the strip similar to the stationary blades or longitudinally moveable blades disclosed in prior embodiments. The splits 537 in transverse blades 539 can be clearly seen in FIG. 58.

Reiterating, therefore, the present inventors have discovered that their invention of thin resilient or flexible wiping blades originally applied in the production of electrolytic coatings is also effective in the electrochemical processing operation known as anodizing. In a sense, anodizing, by which a retentive layer of oxygen is applied to the surface of aluminum and some other light metals, (e.g. magnesium alloys) is the reverse or opposite of electroplating, since in anodizing, the workpiece is made the anode in a circuit with cathodic processing electrodes. The electrolyte in anodizing is an acid solution, frequently sulfuric, chromic or sulfamic acid when treating aluminum alloys. When a voltage is applied across the electrodes, oxygen collects at the anodic surface and hydrogen at the cathodic surface, both derived essentially from electrolysis of the water in the solution or electrolyte. The activated or ionic oxygen rapidly oxidizes the surface of the metal forming a relatively pure and adherent oxygen layer which serves both as a corrosion-resistant surface layer and an adherent base for various dyes and sealing materials. The process depends essentially upon a combination of oxidation of the surface of the metal by the oxygen present, plus partial resolution by the acid and reoxidation resulting in a particularly thick and adherent layer of oxide. At the same time, hydrogen collects at the cathodic electrodes. This collection of hydrogen has a detrimental insulating effect upon the cathodes, leading to increased resistance in the circuit and contributing to high resistance of the process requiring a high voltage and current with a resultant very large power requirement. Excess oxygen also collects as gas bubbles at the anodic workpiece tending to block contact of the workpiece surface with ions of oxygen and insulate the surface so that current flow is made non-uniform to certain areas which may cause burns of the surface. In addition, the growing oxide layer is itself an insulating dielectric which, as electrons are driven across its thickness by the voltage applied, rapidly heats to a high temperature so that the anodizing process is interfered with and the anodizing electrolyte adjacent the surface may even boil or vaporize into a pocketed barrier layer essentially further insulating the surface. The present inventors have found that the use of their thin flexible wiping blades previously applied to electrocoating is effective in decreasing the resistance of the anodizing circuit resulting in lower current usage which result in less heat being generated, therefore reducing the cooling requirements and thus improving energy efficiency. In particular, the use of the dielectric wiping blades in the coating or anodizing of continuous strip and the like allows the anodic workpiece and the cathodic electrodes to be more closely spaced with a considerable saving in power required. This is accomplished through the stabilization of the strip material between the electrodes by the dielectric wiper blades. At the same time the wiper blades wipe away from the surface of the anodic work material the heated surface layer of electrolyte allowing it to be replaced with cooler electrolyte, thus alleviating the surface heating problem just as in electroplating the wiper blades remove or displace the depletion layer of electrolyte that tends to be carried along with the workpiece.

In the anodizing of metals, the collection of hydrogen upon the cathodes also tends to insulate the cathodes, decreasing the efficiency of the anodizing operation. In such case, the efficiency can be increased by also using a wiping means passing over the cathodes. Several arrangements for accomplishing this are illustrated. One further effective arrangement is to provide a thin mesh-type wiper, as shown in FIGS. 45, 46, 49, 50 or 51, and draw it against the inner surfaces of the cathodes by an arrangement such as shown in FIG. 47, where, instead of the mesh wiper contacting the surface of the strip 417, as shown in FIG. 47, the mesh wiper contacts the surface of the cathodes 419. In conjunction with such arrangement, separately supported flexible wiper blades may be supplied to wipe the surface of the web material being anodized to remove both oxygen bubbles plus the heated electrolyte layer as well as stabilize the web.

Figure 59:
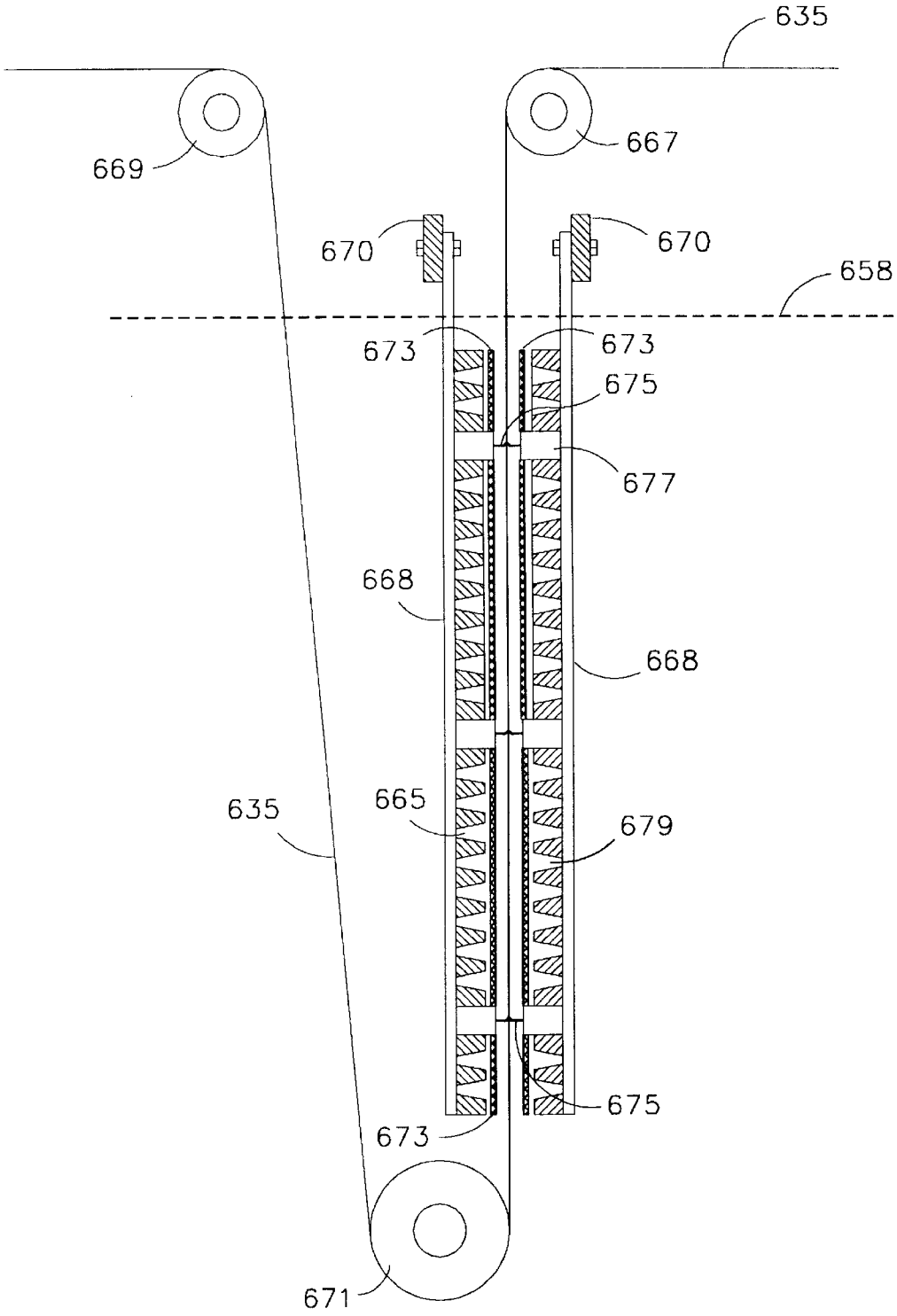
FIG. 59 is a diagrammatic transverse section through a vertically aligned coating arrangement using flexible wiping blades plus an open-web, plastic mesh as combined wiping elements.

FIG. 59 is a diagrammatic side elevation of an arrangement for coating a continuous strip with a chromium or other coating layer in a vertically oriented electrocoating apparatus in which both an open-web plastic mesh is used between the strip and the electrode material and flexible wiping blades are used at intervals along the coating arrangement. As will be understood, the same basic arrangement could be used for anodizing with a change in polarity and other basic adjustments. In such an operation, i.e. a chromium coating process, because the plating is relatively inefficient, a large amount of hydrogen is produced by simultaneous electrolysis of the water in the electrolyte solution, which hydrogen collects upon and coats the surface of the strip interfering with the coating operation. In addition, depletion of the chromium content of the electrolyte occurs. The coating arrangement is shown as a vertical run between perforated lead anodes 665, the strip 635 entering between the anodes at the bottom and progressing upwardly until it passes from the coating operation over the guide roll 667. The strip enters the operation over guide roll 669 above the surface 658 of an electrolytic coating bath 659 and passes around a sinker roll 671 at the bottom before passing up between the perforated anodes 665 which are supported by hangers 668 from bus bars 670 above the surface 672 of an electrolytic bath, not shown. Along the surface of the anodes 665 there is provided an open-webbed plastic mesh such as shown in the previous figures. Such mesh is designated as 673 and serves to keep the strip 635 from contacting the perforated anode 665, even though it is running very close to such anodes. Since a chromium coating operation is a so-called low-efficiency operation, a lot of hydrogen is given off during the operation as indicated above and such hydrogen tends to collect upon the strip 635. Consequently, applicants prefer to also use flexible wiping blades spaced at intervals along the coating operation. These wiping blades are shown as wiping blades 675 supported in holders or in blade tracks 677. The flexible wiping blades 675 very effectively strip the hydrogen bubbles from the surface of the strip 635 and also cause any depleted coating solution to be wiped from the surface whereupon it can be replaced by other coating solution from the tank, not shown, either entering the coating area from the sides between the anodes and the strip or through the perforations 679 in the anodes or from bottom of the tank. The open-web plastic mesh 673 serves as a backup to prevent the strip from touching the anodes, even if the strip overcomes the deflection of the flexible wiping blades 675. Consequently, the flexible wiping blades 675 can be positioned farther apart than they might otherwise be. This illustrates that both the flexible wiping blades and the open-web plastic mesh can be used in the same operation. One is a backup basically for the other and this is particularly desirable in those less efficient plating operations where a large amount of hydrogen or other gas may be given off and tend to interfere with the coating on the surface of the strip. It should be understood that the diagrammatic view shown in FIG. 59 shows the wiping blades stabilizing the strip 635 fairly far from the surface of the open-web, plastic mesh 673. However, normally the flexible wiping blades will be only sufficiently long or long enough to be flexed against the strip surface and the open-web, plastic mesh will be spaced very close to the surface of the strip allowing the surface of the strip to be very close to the surface of the electrodes to obtain maximum current flow between the two. The flexible blades are particularly effective because of their superlative wiping action. However, when the blades are used by themselves i.e. without the open-web, plastic mesh, it may be desirable to use them as close together as six inches or so and it has been found therefore, that if they are used in conjunction with open-web, plastic mesh, as shown, they can be moved significantly farther apart such as two or three feet under the same conditions with a considerable saving in cost and maintenance. Consequently, a combination of flexible wiping blades and open-web, plastic mesh is particularly desirable and effective.

Figure 60:
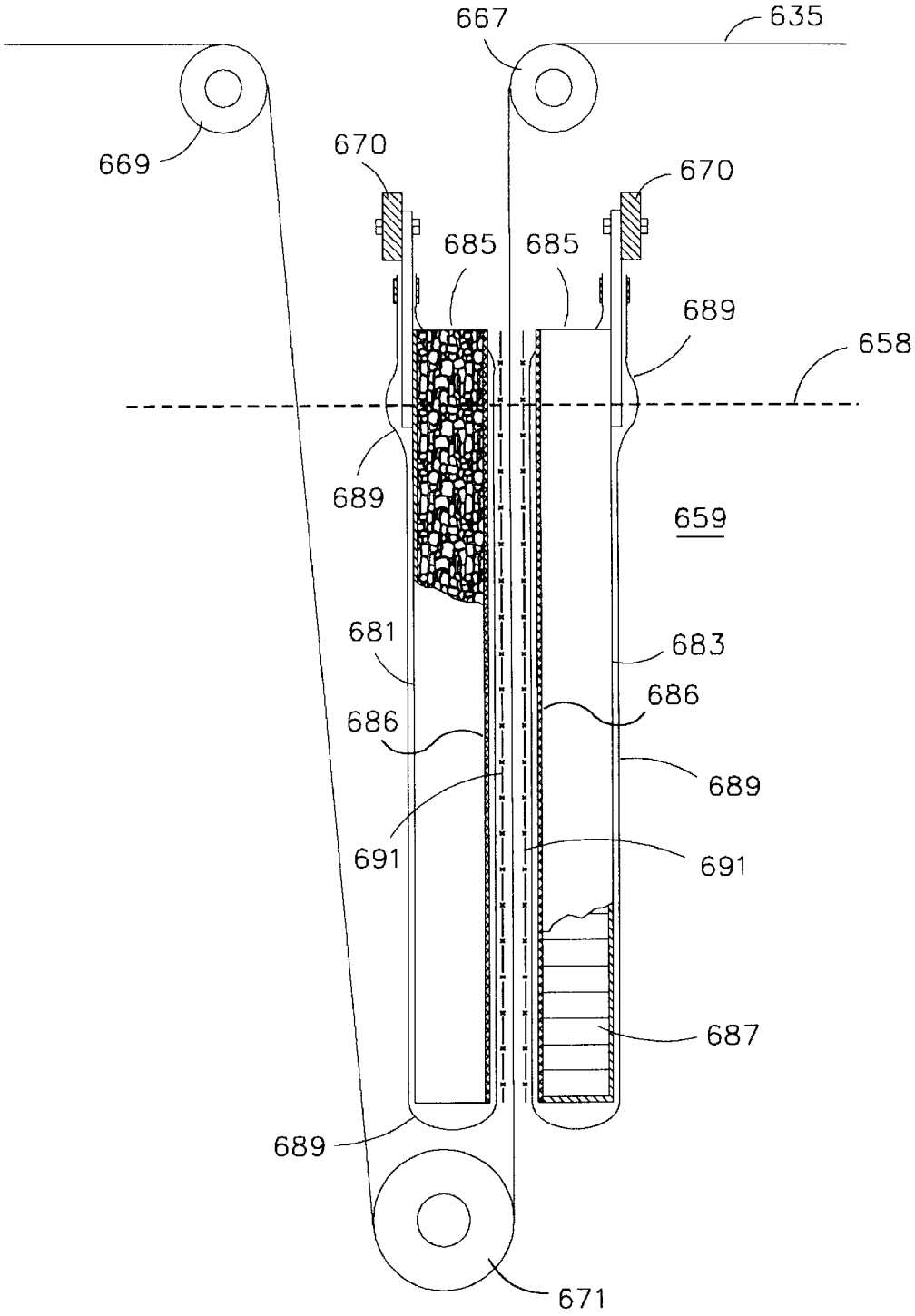
FIG. 60 is a diagrammatic partially broken-away side view of an alternative vertical coating arrangement using an open-web, plastic mesh wiper and spacer.

FIG. 60 shows a further coating arrangement having a vertical orientation. In FIG. 60, a strip 635 again passes over a guide roller 669 down to a sinker roll 671 below the surface 658 of an electrolytic coating bath and then in an upward run between elongated titanium mesh baskets 681 and 683. The baskets 681 and 683 are essentially solid, except for a titanium grid 686 over the surface facing the strip 635. The baskets extend through the surface 658 of the electrolytic bath and are open at the top to allow placement of copper nuggets 685 in them, as shown in basket 681 or, alternatively, copper ingots 687, shown diagrammatically in the basket 683. The titanium screen faces of the two baskets 681 and 683 are covered with a filter cloth 689 to contain any insolubles released by solution of either the copper nuggets 685 or the ingots 687 of copper and has over the filter cloth an open-web, plastic mesh 691. The open-web, plastic mesh 691 serves to prevent contact of the strip 635 with either the filter cloth 689 or the titanium mesh 686 over the face of the titanium baskets which might otherwise result in tearing the filter cloth or in arcing with the titanium mesh. The aim is, of course, to have the surface of the strip as close as possible to both the soluble anode material and the conductive titanium mesh which serves as a current carrier to the adjacent copper nuggets. At the same time, as explained, the plastic mesh 691 being close to the surface of the strip, serves to periodically "wipe" the surface of the strip as the strip approaches the mesh and to cause turbulence and liquid eddy currents in the electrolytic bath which disrupts the barrier layer, or depletion layer, on the surface of the strip, whether such barrier layer is chemical or physical, i.e. depleted of chemical plating elements, or depleted by reason of being physically hotter than surrounding electrolytic which is usually passed through coolers to keep it at a suitable processing temperature. As explained previously, in the case of a reverse polarity anodizing operation, the flexible wiping blades, such as shown in FIG. 59, are particularly effective in removing a heated layer of electrolyte that interferes with anodizing a manner similar to the interference that the normal depletion layer on the surface of strip has on the electroplating of strip.

As will be recognized from the above description and appended drawings, the wiping arrangements of the invention are very effective in both electroplating processes and anodizing processes in removing excess gases from the surface of the workpiece electrodes and continuously replenishing electrolyte adjacent the workpiece as well as preventing accidental contact between cathodic and anodic surfaces during such electro plating or anodizing or in general, any electrochemical reprocessing.

It should be understood that while the present invention has been described at some length, and in considerable detail and with some particularity with regard to several embodiments in connection with the accompanying figures and description, all such description and showing is to be considered illustrative only and the invention is not intended to be narrowly interpreted in connection therewith, or limited to any such particulars or embodiments, but should be interpreted broadly within the scope of the delineation of the invention set forth in the accompanying claims thereby to effectively encompass the intended scope of the invention.

What is claimed is:

1. An improved arrangement for electrochemical processing of metal substrates comprising:

a. an electrolytic processing bath, b. means to support a plurality of electrodes of opposite polarity in the electrolytic processing bath, one of said electrodes being a workpiece for treatment and the other electrodes being treatment electrodes, c. a resilient dielectric wiping means arranged for passage across the surface of at least one of the electrodes to remove gas bubbles as well as nay thin face layer of electrolyte at the surface of said at least one electrode having at least one characteristic different from the remainder of the electrolyte in said bath derived from electrolytic processing, as well as serving as a spacer between the workpiece for treatment and the treatment electrodes to prevent arcing between the workpiece and treatment electrodes, d. the workpiece for treatment and the treatment electrodes being relative movable with respect to each other, and e. wherein the workpiece for treatment is an elongated flexible strip conducted past the remainder of the electrodes and the resilient dielectric wiping means comprises a portion of a laterally extended mesh of intersecting plastic wiper members.

2. An improved arrangement for electrochemical processing in accordance with claim 1 wherein the laterally extended mesh of intersecting plastic wiper members are laterally flattened.

3. An improved arrangement for electrochemical processing in accordance with claim 1 wherein the laterally extended plastic mesh of intersecting laterally flattened plastic wiper members is arranged to pass over the surface of the workpiece in wiping contact therewith.

4. An improved arrangement for electrochemical processing in accordance with claim 1 wherein the laterally extended mesh of intersecting plastic wiper members is arranged to pass over an electrode other than the workpiece in wiping contact therewith.

5. An improved arrangement for electrochemical processing in accordance with claim 4 wherein the electrochemical process is an anodizing process and the laterally extended plastic mesh of intersecting wiper members is drawn across a cathode surface.

6. An improved arrangement for electrochemical processing in accordance with claim 1 wherein the workpiece is a moving strip and the laterally extended mesh of intersecting plastic wiper members is mounted in conjunction with at least one thin laterally extended contact blade which blade contacts the surface of one of the electrodes along a narrow contact interface along one edge.

7. An improved arrangement for electrochemical processing of metal substrates comprising:

a. an electrolytic processing bath, b. means to support a plurality of electrodes of opposite polarity in the electrolytic processing bath, one of said electrodes being a workpiece for treatment and the other electrodes being treatment electrodes, c. a resilient dielectric wiping means arranged for passage across the surface of at least one of the electrodes to remove gas bubbles as well as any thin surface layer of electrolyte at the surface of said at least one electrode having at least one characteristic different from the remainder of the electrolyte in said bath derived from electrolytic processing, as well as serving as a spacer between the workpiece for treatment and the treatment electrodes to prevent arcing between the workpiece and treatment electrodes, d. the workpiece for treatment and the treatment electrodes being relatively movable with respect to each other, and e. wherein the electrochemical process is an anodizing process, the workpiece is an elongated flexible strip conducted past the remainder of the electrodes, and the resilient dielectric wiping means comprises at least one thin laterally extended contact blade arranged to resiliently contact one of the electrodes and the thin contact blade contacts the surface of such one of the electrodes along a narrow contact interface along one edge.

8. An improved arrangement for electrochemical processing in accordance with claim 7 wherein the distance between the one of the electrodes which is the workpiece and an adjacent processing electrode is between 1/16 inch and 2 inches and the thickness of the thin contact blade is between 1/32 inch and 1/4 inch.

9. An improved arrangement for electrochemical processing in accordance with claim 8 whereas the distance between the one of the electrodes which is the workpiece and the surface of the adjacent processing treatment electrode is between 1/16 inch and 1 inch.

10. An improved arrangement for electrochemical processing in accordance with claim 9 wherein the distance between the surface of the one of the electrodes which is the workpiece and the adjacent electrode is 1/4 inch to 3/8 inch and the thickness of the thin contact blade is between 1/16 inch to 1/8 inch.

11. An improved arrangement for electrochemical processing in accordance with claim 7 wherein the thin laterally extended contact blade is mounted adjacent at least one perforated electrode.

12. An improved arrangement for electrochemical processing in accordance with claim 11 wherein the thin laterally extended contact blade is mounted integrally with the perforated electrode and such electrode is a perforated anode mounted in an electrolytic coating bath.

13. An improved arrangement for electrolytic processing in accordance with claim 11 wherein the thin laterally extended contact blade is mounted integrally with the perforated electrode and such electrode is a perforated cathode in an anodizing bath.

14. A method of saving energy in electrochemical processing by allowing closer spacing between a workpiece and an adjacent electrodes and by preventing the accumulation of overheated, spent electrolyte between the workpiece and adjacent electrodes comprising stabilizing a workpiece between opposed flexible plastic wiping blades while removing the immediate surface layer of electrolyte from the surface of the workpiece to allow fresh electrolyte to reach the surface.

15. An improved arrangement for electrochemical processing of metal substrates comprising:

a. an electrochemical processing bath, b. means to pass an anodic metal strip workpiece through the electrochemical processing bath, c. electrode means adjacent the path of the workpiece through the processing bath, d. a dielectric wiping means positioned between the electrode means and the path of the workpiece through the bath, e. said dielectric wiping means being in the form of an open web, plastic mesh member oriented between the workpiece path and the cathode such that the mesh pattern is oriented toward the workpiece and mounted such that said dielectric wiping means brushes the workpiece and f. wherein the plastic mesh is of sufficient thickness to prevent arcing between the metal strip workpiece and the electrodes due to too close approach of the workpiece and the electrodes.

16. An improved arrangement for electrochemical processing of metal substrates in accordance with claim 15 wherein the plastic mesh brushes against the metal strip workpiece at various consecutive sectors of movement of such workpiece.

17. An improved arrangement for electrochemical processing of metal substrate in accordance with claim 15 wherein the plastic mesh is maintained continuously against the metal strip workpiece.

18. An improved arrangement for electrochemical processing of metal substrate in accordance with claim 15 wherein the plastic mesh is maintained at least intermittently against the surface of the metal strip workpiece being anodized.

19. An improved arrangement for electrochemical processing of metal substrate in accordance with claim 15 wherein the plastic mesh is between one-eighth and one-quarter inch in thickness.

20. An improved arrangement for electrochemical processing of metal substrate in accordance with claim 19 wherein the plastic mesh is positioned statically against the surface of the metal strip workpiece as such strip passes by the plastic mesh.

21. An improved arrangement for electrochemical processing of metal substrate in accordance with claim 19 wherein the plastic mesh is drawn across the metal strip workpiece.

22. An improved arrangement for electrochemical processing of metal substrate in accordance with claim 19 wherein the plastic mesh is adapted to remove gas bubbles, strip away excessively-heated electrolytes from the surface of the strip and prevent too close approach of the anodic metal strip workpiece to the electrodes.

23. An apparatus arrangement for stabilizing the path of an elongated flexible metal workpiece past treatment electrodes in an electrochemical processing operation comprising:

a. at least one electrode positioned adjacent the path of an elongated flexible metal workpiece of opposite polarity, b. means to bath e opposing surfaces of the electrode and workpiece in an electrolytic solution, c. flexible dielectric spacer means extended generally transversely across the surface of the workpiece in at least partial contact with the surface of the workpiece opposed to the surface of the electrode and closely adjacent the opposed surface of the electrode in a position to serve as a dielectric spacer between the opposed surfaces of the electrode and the workpiece whereby the spacing between the electrode and workpiece is stabilized enabling the electrode to be spaced more closely to the workpiece than otherwise thereby reducing power consumed in the electrochemical processing for comparable degrees of processing.

24. An apparatus arrangement for stabilizing the path of an elongated flexible metal workpiece past treatment electrodes in accordance with claim 23 wherein the flexible dielectric spacer means is comprised of at least one resilient dielectric wiper blade having a narrow edge contact with the workpiece.

25. An apparatus arrangement for stabilizing the path of an elongated flexible metal workpiece past treatment electrodes in accordance with claim 24 wherein the resilient dielectric wiper blade is a flexible blade with its edge flexed against the surface of the workpiece.

26. An apparatus arrangement for stabilizing the path of an elongated flexible metal workpiece past treatment electrodes in accordance with claim 23 wherein the flexible dielectric spacer means is comprised of a dielectric mesh member comprised of a unitary intersecting grid arrangement with included orifices forming a geometrical mesh pattern extending transversely and longitudinally of and in at least partial contact with the surface of the elongated flexible workpiece between the opposed surfaces of the workpiece and electrode.

27. An apparatus arrangement for stabilizing the path of an elongated flexible metal workpiece past treatment electrodes in accordance with claim 26 wherein solid intersecting grid members of the geometrical mesh are thinner than the thickness of the mesh member.

28. An apparatus arrangement for stabilizing the path of an elongated flexible metal workpiece past treatment electrodes in accordance with claim 27 wherein the metal workpiece is anodic and the electrodes are cathodic.

29. An apparatus arrangement for stabilizing the path of an elongated flexible metal workpiece past treatment electrodes in an electrochemical processing operation comprising:

a. at least one electrode positioned adjacent the path of an elongated flexible metal workpiece of opposite polarity, b. means to bathe opposing surfaces of the electrode and workpiece in an electrolytic solution, c. flexible perforate dielectric spacer means extended generally transversely across the surface of the workpiece and closely adjacent and parallel to such surface of the workpiece opposed to the surface of the electrode and closely adjacent the opposed surface of the electrode in a position to serve as a dielectric spacer between the opposed surfaces of the electrode and the workpiece, whereby the spacing between the electrode and workpiece is stabilized enabling the electrode to be spaced more closely to the workpiece than otherwise thereby reducing power consumed in the electrochemical processing operation for comparable degrees of processing.

30. An apparatus arrangement for stabilizing the path of an elongated flexible metal workpiece past treatment electrodes in accordance with claim 29 wherein the flexible perforate dielectric spacer means is comprised of a dielectric mesh member.

31. An apparatus arrangement for stabilizing the path of an elongated flexible metal workpiece past treatment electrodes in accordance with claim 30 wherein the dielectric mesh member is comprised of a dielectric mesh member comprised of a unitary intersecting grid arrangement with included orifices forming a geometrical mesh pattern extending transversely and longitudinally of and in at least partial contact with the surface of the elongated flexible workpiece between the opposed surfaces of the workpiece and electrode.

32. An apparatus arrangement for stabilizing the path of an elongated flexible metal workpiece past treatment electrodes in accordance with claim 31 wherein the geometrical mesh pattern is a component of a unitary open web, plastic mesh.

33. An apparatus arrangement for stabilizing the path of an elongated flexible metal workpiece past treatment electrodes in accordance with claim 32 wherein the metal workpiece is anodic and the electrodes are cathodic.

34. An apparatus arrangement for stabilizing the path of an elongated flexible metal workpiece past treatment electrodes in accordance with claim 32 wherein the open web, plastic mesh is arranged to not normally contact the surface of the workpiece.

35. An apparatus arrangement for stabilizing the path of an elongated flexible metal workpiece past treatment electrodes in accordance with claim 34 wherein the metal workpiece is anodic and the electrodes are cathodic.

36. An apparatus arrangement for stabilizing the path of an elongated flexible metal workpiece past treatment electrodes in accordance with claim 34 wherein the open web, plastic mesh spacer is combined with resilient dielectric wiper blades having their edges flexed against the surface of the workpiece to aid in stabilizing the workpiece.

37. An apparatus arrangement for stabilizing the path of an elongated flexible metal workpiece past treatment electrodes in accordance with claim 36 wherein the metal workpiece is anodic and the electrodes are cathodic.

* * * * *